US010254669B2

(12) United States Patent
Shimizu

(10) Patent No.: US 10,254,669 B2
(45) Date of Patent: Apr. 9, 2019

(54) METHOD FOR MANUFACTURING TONER FOR ELECTROSTATIC IMAGE DEVELOPMENT

(71) Applicant: KAO CORPORATION, Tokyo (JP)

(72) Inventor: Akitaka Shimizu, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 15/539,035

(22) PCT Filed: Dec. 24, 2015

(86) PCT No.: PCT/JP2015/086127
§ 371 (c)(1),
(2) Date: Jun. 22, 2017

(87) PCT Pub. No.: WO2016/104656
PCT Pub. Date: Jun. 30, 2016

(65) Prior Publication Data

US 2017/0371255 A1 Dec. 28, 2017

(30) Foreign Application Priority Data

Dec. 26, 2014 (JP) ..... 2014-266665

(51) Int. Cl.
*G03G 9/087* (2006.01)
*G03G 9/08* (2006.01)

(52) U.S. Cl.
CPC ..... *G03G 9/08704* (2013.01); *G03G 9/0804* (2013.01); *G03G 9/08708* (2013.01); *G03G 9/08711* (2013.01); *G03G 9/08728* (2013.01); *G03G 9/08755* (2013.01); *G03G 9/08782* (2013.01)

(58) Field of Classification Search
CPC ..... G03G 9/08704; G03G 9/08728; G03G 9/08755; G03G 9/08708
See application file for complete search history.

(56) References Cited

U.S. PATENT DOCUMENTS 8,993,208 B2 3/2015 Matsushima et al.
2003/0232268 A1 12/2003 Sacripante et al.
2012/0264045 A1 10/2012 Matsushima et al.
2013/0330666 A1* 12/2013 Fukuri ..... G03G 9/08755 430/109.4
2016/0179021 A1 6/2016 Mizuhata et al.

FOREIGN PATENT DOCUMENTS

| | | | |
|---|---|---|---|
| JP | 2007-93809 | A | 4/2007 |
| JP | 2010-156747 | A | 7/2010 |
| JP | 2010-169702 | A | 8/2010 |
| JP | 2012-128024 | A | 7/2012 |
| JP | 2012-228876 | A | 11/2012 |
| JP | 2013-134486 | A | 7/2013 |
| JP | 2014-89442 | A | 5/2014 |
| JP | 2015-45840 | A | 3/2015 |
| JP | 2016-9060 | A | 1/2016 |

OTHER PUBLICATIONS

Extended European Search Report dated Jun. 19, 2018 in Patent Application No. 15873224.8, 7 pages.
International Search Report dated Apr. 5, 2016, in PCT/JP2015/086127 filed Dec. 24, 2015.

* cited by examiner

*Primary Examiner* — Thorl Chea
(74) *Attorney, Agent, or Firm* — Oblon, McClelland, Maier & Neustadt, L.L.P.

(57) ABSTRACT

The present invention relates to a process for producing a toner for development of electrostatic images, including step (1) of mixing a releasing agent and a water dispersion of resin particles (A) to obtain a water dispersion of releasing agent particles; step (2) of mixing the obtained water dispersion of the releasing agent particles and a water dispersion of resin particles (B) to aggregate the releasing agent particles and the resin particles (B), thereby obtaining aggregated particles; and step (3) of coalescing the obtained aggregated particles to obtain coalesced particles, in which the resin particles (A) include a composite resin including a segment (a1) constituted of a polyester resin and a vinyl-based resin segment (a2) containing a constitutional unit derived from a styrene-based compound; and a resin constituting the resin particles (B) includes a segment (b1) constituted of a polyester resin in an amount of not less than 50% by mass.

18 Claims, No Drawings

METHOD FOR MANUFACTURING TONER FOR ELECTROSTATIC IMAGE DEVELOPMENT

CROSS REFERENCE TO RELATED APPLICATIONS

This application is a national stage entry under 35 USC 371 of PCT/JP2015/086127 filed on Dec. 24, 2015, and claims priority to Japanese Patent Application No. 2014-266665 filed on Dec. 26, 2014.

FIELD OF THE INVENTION

The present invention relates to a process for producing a toner for development of electrostatic images.

BACKGROUND OF THE INVENTION

In recent years, in the field of toners for electrophotography, with the progress of electrophotographic systems, it has been demanded to develop toners adaptable for high image quality and high copying or printing speed. From the viewpoint of the high image quality, the toners have been required to have a small particle size. Thus, there have been disclosed processes for producing a so-called chemical toner by a chemical method such as a suspension polymerization method, an emulsion polymerization method and a dissolution suspension method in place of the conventional melt-kneading method. Further, from the viewpoint of the high copying or printing speed, there has been reported a chemical toner to which a releasing agent is internally added in order to improve low-temperature fusing properties thereof.

For example, JP 2010-169702A discloses a toner including core particles produced by aggregating at least resin particles, colorant particles and wax particles, in which a dispersant used in a dispersion of the wax particles contains a polypropylene glycol ethyleneoxide adduct. JP 2010-169702A also describes that the problem that the wax particles or the colorant particles are not aggregated with the other components of the core particles in an aqueous system and therefore remain unincorporated into the core particles can be solved, so that it is possible to produce toner particles having a narrow particle size distribution and a small particle size.

JP 2012-128024A discloses a process for producing a toner including the steps of mixing resin particles containing a polyester as a main component, releasing agent particles containing a wax and a polyester resin having a specific softening point at a specific weight ratio, and an aggregating agent in an aqueous medium to obtain aggregated particles (1); mixing the aggregated particles (1) with polyester-containing resin particles serving as a shell to obtain aggregated particles (2); and coalescing the particles constituting the aggregated particles (2) to obtain core/shell particles. In JP 2012-128024A, it is described that the toner obtained by the production process is excellent in low-temperature fusing properties and heat-resistant storage properties.

JP 2014-89442A discloses a process for producing a toner for electrophotography which is capable of suppressing isolation of a wax from a resin binder as well as exposure of the wax onto the surface of respective toner particles in the step of obtaining coalesced particles upon production of the toner, reducing the amount of a fine powder included in the toner, and providing the toner that is excellent in low-temperature fusing properties and anti-hot offset properties. In JP 2014-89442A, it is also described that in the aforementioned process, a water dispersion of releasing agent particles obtained by mixing and emulsifying the wax with an emulsion of a resin having a specific acid value and an oxazoline group-containing polymer is mixed with a water dispersion of resin particles including the resin binder containing a carboxy group, and the resulting mixture is aggregated and then coalesced to obtain coalesced particles.

SUMMARY OF THE INVENTION

The present invention relates to a process for producing a toner for development of electrostatic images, including the following steps (1) to (3):

step (1): mixing a releasing agent and a water dispersion of resin particles (A) to obtain a water dispersion of releasing agent particles;

step (2): mixing the water dispersion of the releasing agent particles obtained in the step (1) and a water dispersion of resin particles (B) to aggregate the releasing agent particles and the resin particles (B), thereby obtaining aggregated particles; and step (3): coalescing the aggregated particles obtained in the step (2) to obtain coalesced particles, in which the resin particles (A) include a composite resin including a segment (a1) constituted of a polyester resin and a vinyl-based resin segment (a2) containing a constitutional unit derived from a styrene-based compound; and a resin constituting the resin particles (B) includes a segment (b1) constituted of a polyester resin in an amount of not less than 50% by mass.

DETAILED DESCRIPTION OF THE INVENTION

When producing a toner by a chemical method, there tends to occur such a problem that a releasing agent is insufficient in dispersibility in the toner because the chemical method includes no kneading step unlike the melt-kneading/pulverization method. For this reason, in the chemical method, a surfactant is used to disperse the releasing agent in an aqueous medium. However, when using the surfactant together with the releasing agent, although the releasing agent is improved in dispersion stability, there tends to arise such a problem that in the step subsequent to the aggregating step in which the releasing agent is aggregated together with resin particles in the aqueous medium, in particular, in the coalescing step, the releasing agent is desorbed from the resulting toner particles, or the releasing agent is exposed to the surface of the respective toner particles. Therefore, in the chemical method, the resulting toner tends to be deteriorated in flowability and insufficient in solid-image followup ability upon printing.

Meanwhile, the term "solid-image followup ability" as used herein means a stability of an image density of a solid image on a paper when printing out the solid image thereon.

The present invention relates to a process for producing a toner for development of electrostatic images in which the resulting toner is capable of suppressing desorption and exposure of a releasing agent contained therein, and excellent in solid-image followup ability upon printing (image density stability); and a process for producing a water dispersion of releasing agent particles.

The present inventors have found that by using resin particles including a composite resin that includes a segment constituted of a polyester resin and a vinyl-based resin segment containing a constitutional unit derived from a styrene-based compound upon dispersing a releasing agent in an aqueous medium, it is possible to produce a water dispersion of releasing agent particles without particularly using a dispersant such as a surfactant. In addition, the present inventors have found that when producing a toner by the chemical method in which resin particles prepared from a polyestyer resin are aggregated using the water dispersion of the releasing agent particles, it is possible to suppress desorption of the releasing agent from the toner particles in the toner production step as well as exposure of the releasing agent onto the surface of the resulting respective toner particles.

That is, the present invention relates to the following aspects [1] and [2].

[1] A process for producing a toner for development of electrostatic images, including the following steps (1) to (3):

step (1): mixing a releasing agent and a water dispersion of resin particles (A) to obtain a water dispersion of releasing agent particles;

step (2): mixing the water dispersion of the releasing agent particles obtained in the step (1) and a water dispersion of resin particles (B) to aggregate the releasing agent particles and the resin particles (B), thereby obtaining aggregated particles; and step (3): coalescing the aggregated particles obtained in the step (2) to obtain coalesced particles, in which the resin particles (A) include a composite resin including a segment (a1) constituted of a polyester resin and a vinyl-based resin segment (a2) containing a constitutional unit derived from a styrene-based compound; and a resin constituting the resin particles (B) includes a segment (b1) constituted of a polyester resin in an amount of not less than 50% by mass.

[2] A process for producing a water dispersion of releasing agent particles, including the following step (1):

step (1): mixing a releasing agent and a water dispersion of resin particles (A) to obtain the water dispersion of the releasing agent particles, in which the resin particles (A) include a composite resin including a segment (a1) constituted of a polyester resin and a vinyl-based resin segment (a2) containing a constitutional unit derived from a styrene-based compound in an amount of not less than 90% by mass.

In accordance with the present invention, there are provided a process for producing a toner for development of electrostatic images in which the resulting toner is capable of suppressing desorption and exposure of a releasing agent contained therein, and excellent in solid-image followup ability upon printing; and a process for producing a water dispersion of releasing agent particles.

[Process for Producing Toner for Development of Electrostatic Images]

The process for producing a toner for development of electrostatic images according to the present invention includes the following steps (1) to (3):

step (1): mixing a releasing agent and a water dispersion of resin particles (A) to obtain a water dispersion of releasing agent particles;

step (2): mixing the water dispersion of the releasing agent particles obtained in the step (1) and a water dispersion of resin particles (B) to aggregate the releasing agent particles and the resin particles (B), thereby obtaining aggregated particles; and step (3): coalescing the aggregated particles obtained in the step (2) to obtain coalesced particles.

Incidentally, in the process for producing a toner for development of electrostatic images according to the present invention, the resin particles (A) include a composite resin including a segment (a1) constituted of a polyester resin obtained by polycondensing an alcohol component and a carboxylic acid component and a vinyl-based resin segment (a2) containing a constitutional unit derived from a styrene-based compound. Furthermore, the resin constituting the resin particles (B) includes a segment (b1) constituted of a polyester resin in an amount of not less than 50% by mass.

In addition, the step (2) may also include the following steps (2A) and (2B):

step (2A); mixing the water dispersion of the releasing agent particles obtained in the step (1), the water dispersion of the resin particles (B) and an aggregating agent with each other in an aqueous medium to obtain aggregated particles (1); and step (2B); adding resin particles (C) to the aggregated particles (1) obtained in the step (2A) at one time or plural times in a split addition manner to obtain aggregated particles (2) formed by adhering the resin particles (C) onto the aggregated particles (1).

Meanwhile, in the case where the step (2A) and the step (2B) both are carried out, the "aggregated particles obtained in the step (2)" as described in the step (3) mean the "aggregated particles (2) obtained in the step (2B)". On the other hand, in the case where the step (2A) is carried out but no step (2B) is carried out, the "aggregated particles obtained in the step (2)" as described in the step (3) mean the "aggregated particles (1) obtained in the step (2A)".

The detailed mechanism of obtaining the toner that is capable of suppressing desorption and exposure of a releasing agent contained therein, and excellent in solid-image followup ability upon printing, by the production process of the present invention is considered as follows, though it is not clearly determined yet.

As described above, when producing a toner by a chemical method, if a surfactant is used upon dispersing a releasing agent in an aqueous medium, the releasing agent tends to be desorbed from the obtained aggregated particles serving as a base material of the toner, in particular, upon coalescence of the particles, or the releasing agent tends to be exposed to the surface of the respective toner particles, owing to a high dispersion force of the surfactant. In order to avoid these problems, it is desired to disperse the releasing agent in the aqueous medium without using the surfactant, if possible. In the present invention, the releasing agent particles are dispersed in the aqueous medium using the resin particles containing the composite resin. In this case, it is considered that by using such a composite resin including a segment (a1) constituted of a polyester resin obtained by polycondensing an alcohol component and a carboxylic acid component and a vinyl-based resin segment (a2) containing a constitutional unit derived from a styrene-based compound as the composite resin constituting the resin particles, the releasing agent can be well dispersed in the aqueous medium via the polyester resin segment (a1) having an adequate polarity as if the resin particles are used in place of a surfactant. Further, it is considered that since the resin constituting the resin particles forming a resin binder as a base material of the toner (resin particles (B)) includes the segment (b1) constituted of a polyester resin in an amount of not less than 50% by mass, the resin particles (B) tends to be compatible with the polyester resin segment (a1) contained in the composite resin, so that the releasing agent particles tend to be incorporated into aggregates of the resin particles (B) by stirring and mixing in the aggregating step. Furthermore, it is considered that since the polyester resin segments of the composite resin and the resin particles (B) tend to be integrated together in the coalescing step and, in such a case, the vinyl-based resin segment (a2) containing a constitutional unit derived from a styrene-based compound has good compatibility with the releasing agent having a low polarity, it is possible to suppress desorption of the releasing agent form the toner and exposure of the releasing agent onto the surface of the toner, so that the resulting toner can be improved in solid-image followup ability upon printing without suffering from deterioration in flowability of the toner owing to the releasing agent.

In the following, the respective components and steps used in the production process of the present invention are described in detail.

<Step (1)>

In the step (1) of the process for producing a toner according to the present invention, the releasing agent is mixed with the water dispersion of the resin particles (A) to thereby obtain a water dispersion of releasing agent particles.

(Releasing Agent)

Examples of the releasing agent include mineral or petroleum waxes, synthetic waxes, low-molecular weight polyolefins, silicone waxes, fatty acid amides, vegetable waxes and animal waxes.

Specific examples of the mineral or petroleum waxes include a montan wax, a paraffin wax and a Fischer-Tropsch wax. Of these mineral or petroleum waxes, the paraffin wax is preferred from the viewpoint of improving releasing properties and solid-image followup ability of the resulting toner.

Specific examples of the preferred synthetic waxes include an ester wax.

Specific examples of the preferred low-molecular weight polyolefins include polyethylene, polypropylene and polybutene.

Specific examples of the preferred fatty acid amides include oleamide and stearamide.

Specific examples of the preferred vegetable waxes include a carnauba wax, a rice wax and a candelilla wax.

Specific examples of the preferred animal waxes include beeswaxes.

Among these releasing agents, from the viewpoint of improving releasing properties and solid-image followup ability of the resulting toner, preferred are mineral or petroleum waxes and synthetic waxes, more preferred is at least one wax selected from the group consisting of an ester wax and a paraffin wax, and even more preferred is a paraffin wax.

For example, from the viewpoint of improving releasing properties and solid-image followup ability of the resulting toner, it is more preferred that the releasing agent includes a paraffin wax in an amount of not less than 95% by mass.

The melting point of the releasing agent is preferably not lower than 60° C., more preferably not lower than 65° C. and even more preferably not lower than 70° C. from the viewpoint of improving releasing properties and solid-image followup ability of the resulting toner, and is also preferably not higher than 100° C., more preferably not higher than 95° C., even more preferably not higher than 90° C. and further even more preferably not higher than 85° C. from the viewpoint of improving low-temperature fusing properties of the resulting toner and widening a temperature range in which the toner can be fused. When using two or more kinds of releasing agents in combination with each other, the melting points of these releasing agents all are in the range of not lower than 60° C. and not higher than 100° C. More specifically, when using two or more kinds of releasing agents in combination with each other, it is preferable to use at least two kinds of releasing agents each having a melting point of not lower than 60° C. and not higher than 100° C., and it is more preferable to use at least two kinds of releasing agents each having a melting point of not lower than 60° C. and not higher than 90° C.

In the present invention, the melting point of the releasing agent may be determined by the method described in Examples below. When using two or more kinds of releasing agents in combination with each other, the melting point of the releasing agent as defined in the present invention means a melting point of the releasing agent having a largest mass ratio among the releasing agents contained in the resulting toner. Meanwhile, if all of the releasing agents have the same mass ratio, the lowest melting point among those of the releasing agents is regarded as the melting point of the releasing agent as defined in the present invention.

The amount of the releasing agent used is preferably not less than 1 part by mass, more preferably not less than 2 parts by mass and even more preferably not less than 3 parts by mass on the basis of 100 parts by mass of the resins in the toner from the viewpoint of improving releasing properties and solid-image followup ability of the resulting toner, and is also preferably not more than 10 parts by mass and more preferably not more than 5 parts by mass on the basis of 100 parts by mass of the resin in the toner from the viewpoint of suppressing desorption and exposure of the releasing agent.

(Resin Particles (A))

The resin particles (A) include the composite resin including the segment (a1) constituted of a polyester resin and the vinyl-based resin segment (a2) containing a constitutional unit derived from a styrene-based compound. The resin particles (A) have a function as a dispersant for the releasing agent. One of the large features of the present invention resides in that the releasing agent particles contain the resin particles (A). It is considered that since the releasing agent is dispersed in the aqueous medium via the resin particles (A) having an adequate polarity, a stable dispersion can be obtained even without adding a surfactant thereto, and the releasing agent particles are likely to be incorporated into aggregates of the resin (binder) particles (B) by stirring and mixing in the aggregating step, or the releasing agent particles thus incorporated tend to be hardly desorbed or separated from the obtained aggregated particles.

[Composite Resin]

The composite resin includes the segment (a1) constituted of a polyester resin and the vinyl-based resin segment (a2) containing a constitutional unit derived from a styrene-based compound.

The content of the composite resin in the resin particles (A) is preferably not less than 90% by mass, more preferably not less than 95% by mass, even more preferably not less than 98% by mass, further even more preferably not less than 99% by mass and still further even more preferably 100% by mass, and is also not more than 100% by mass, from the viewpoint of improving dispersion stability of the releasing agent particles.

<<Polyester Resin Segment (a1)>>

The raw material monomers constituting the polyester resin segment (a1) in the composite resin contained in the resin particles (A) include an alcohol component and an acid component. As the alcohol component and the acid component, there may be used an optional alcohol component and an optional carboxylic acid component, respectively.

From the viewpoint of improving dispersion stability of the releasing agent particles, the acid component constituting the segment (a1) preferably contains an aliphatic carboxylic acid.

In the present invention, the aliphatic carboxylic acid component generally means an aliphatic dicarboxylic acid, a trivalent or higher-valent aliphatic polycarboxylic acid, and an anhydride and an alkyl (having not less than 1 and not more than 3 carbon atoms) ester of these acids among the carboxylic acid components constituting the polyester resin segment. When incorporating the aliphatic carboxylic acid component in the acid component constituting the segment (a1), the polyester chain can be improved in flexibility, so that it is possible to obtain the resin particles (A) having such a volume median particle size ($D_{50}$) as being capable of well dispersing the releasing agent in the aqueous medium.

Examples of the aliphatic dicarboxylic acid include sebacic acid, fumaric acid, maleic acid, adipic acid, succinic acid, cyclohexanedicarboxylic acid, and a substituted succinic acid containing an alkyl group having not less than 1 and not more than 20 carbon atoms or an alkenyl group having not less than 2 and not more than 20 carbon atoms as a substituent group. Specific examples of the substituted succinic acid containing an alkyl group having not less than 1 and not more than 20 carbon atoms or an alkenyl group having not less than 2 and not more than 20 carbon atoms as a substituent group include dodecylsuccinic acid, dodecenylsuccinic acid and octenylsuccinic acid. Specific examples of the trivalent or higher-valent aliphatic polycarboxylic acid include butane-1,2,4-tricarboxylic acid, 1,3,6-hexanetricarboxylic acid and cyclohexane-1,2,3-tricarboxylic acid.

Of these acids, preferred is at least one acid selected from the group consisting of fumaric acid, sebacic acid, succinic acid, a substituted succinic acid containing an alkenyl group having not less than 2 and not more than 20 carbon atoms as a substituent group, and an anhydride of these acids, more preferred is at least one acid selected from the group consisting of fumaric acid, sebacic acid and succinic acid, and even more preferred is at least one acid selected from the group consisting of fumaric acid and succinic acid.

Specific examples of the dicarboxylic acid other than the aliphatic carboxylic acid include aromatic dicarboxylic acids. Examples of the aromatic dicarboxylic acids include phthalic acid, isophthalic acid and terephthalic acid. Of these dicarboxylic acids, from the viewpoint of improving durability and charging properties of the resulting toner, preferred are the aromatic dicarboxylic acids, and more preferred is terephthalic acid.

Examples of the trivalent or higher-valent polycarboxylic acid other than the aliphatic carboxylic acid include aromatic polycarboxylic acids. Specific examples of the trivalent or higher-valent aromatic polycarboxylic acid include trimellitic acid, 2,5,7-naphthalene-tricarboxylic acid and pyromellitic acid.

The acid component constituting the polyester resin segment (a1) preferably includes an aliphatic carboxylic acid, more preferably at least an aliphatic dicarboxylic acid, and even more preferably an aliphatic dicarboxylic acid and an aromatic dicarboxylic acid These carboxylic acid components may be used alone or in combination of any two or more thereof.

The content of the aliphatic carboxylic acid component in the acid component constituting the polyester resin segment (a1) is preferably not less than 10% by mass and more preferably not less than 15% by mass, and is also preferably not more than 80% by mass and more preferably not more than 70% by mass, from the viewpoint of improving dispersion stability of the releasing agent particles.

The content of the aromatic dicarboxylic acid in the acid component constituting the polyester resin segment (a1) is preferably not less than 10% by mass, more preferably not less than 15% by mass and even more preferably not less than 20% by mass, and is also preferably not more than 90% by mass, more preferably not more than 85% by mass and even more preferably not more than 80% by mass, from the viewpoint of improving dispersion stability of the releasing agent particles.

Examples of the alcohol component include aromatic diols, aliphatic diols having not less than 2 and not more than 12 main-chain carbon atoms, alicyclic diols, trivalent or higher-valent polyhydric alcohols, and alkylene (having not less than 2 and not more than 4 carbon atoms) oxide adducts (average molar number of addition of alkyleneoxide: not less than 1 and not more than 16) of these alcohol components.

Specific examples of the preferred alcohol component include alkylene (having not less than 2 and not more than 3 carbon atoms) oxide adducts (average molar number of addition of alkyleneoxide: not less than 1 and not more than 16) of bisphenol A such as polyoxypropylene-2,2-bis(4-hydroxyphenyl)propane and polyoxyethylene-2,2-bis(4-hydroxyphenyl)propane; alicyclic diols such as hydrogenated products of bisphenol A, and alkylene (having not less than 2 and not more than 4 carbon atoms) oxide adducts (average molar number of addition of alkyleneoxide; not less than 1 and not more than 16) thereof, aliphatic diols having not less than 2 and not more than 12 main-chain carbon atoms such as ethylene glycol, propylene glycol, neopentyl glycol, 1,4-butanediol, 1,3-butanediol and 1,6-hexanediol, and alkylene (having not less than 2 and not more than 4 carbon atoms) oxide adducts (average molar number of addition of alkyleneoxide; not less than 1 and not more than 16) thereof; and trivalent or higher-valent polyhydric alcohols such as glycerin, pentaerythritol, trimethylol propane and sorbitol, and alkylene (having not less than 2 and not more than 4 carbon atoms) oxide adducts (average molar number of addition of alkyleneoxide; not less than 1 and not more than 16) thereof. These alcohol components may be used in combination of any two or more thereof. Of these alcohol components, from the viewpoint of improving durability of the resulting toner, preferred are those alcohol components containing aromatic diols, and more preferred are alkylene (having not less than 2 and not more than 3 carbon atoms) oxide adducts (average molar number of addition of alkyleneoxide: not less than 1 and not more than 16) of bisphenol A such as polyoxypropylene-2,2-bis(4-hydroxyphenyl)propane and polyoxyethylene-2,2-bis(4-hydroxyphenyl)propane.

The content of the aromatic diol in the alcohol component is preferably not less than 70 mol %, more preferably not less than 80 mol %, even more preferably not less than 90 mol %, further even more preferably not less than 95 mol % and still further even more preferably 100 mol %.

The total content of the aforementioned acid component and alcohol component in the components constituting the polyester resin segment (a1) is preferably not less than 80% by mass, more preferably not less than 90% by mass, even more preferably not less than 95% by mass, further even more preferably not less than 98% by mass and still further even more preferably 100% by mass.

In addition, the proportion of the acid component to 100 mole parts of the alcohol component is preferably not less than 70 mole parts, more preferably not less than 75 mole parts and even more preferably not less than 80 mole parts, and is also preferably not more than 110 mole parts, more preferably not more than 105 mole parts and even more preferably not more than 100 mole parts.

<<Vinyl-Based Resin Segment (a2)>>

The vinyl-based resin segment (a2) contains a constitutional unit derived from a styrene-based compound.

Since the vinyl-based resin segment (a2) has good compatibility with the releasing agent having a low polarity, it is considered that the releasing agent can be prevented from suffering from desorption from the obtained particles upon the aggregating and coalescing steps as well as exposure onto the surface of the toner, so that the resulting toner is free from deterioration in flowability owing to the releasing agent and can be improved in solid-image followup ability upon printing.

In addition, it is preferred that the vinyl-based resin segment (a2) also contains a constitutional unit derived from a vinyl monomer other than the styrene-based compound.

As the styrene-based compound, there may be mentioned substituted or unsubstituted styrene. Examples of the substituent group of the substituted styrene include an alkyl group having not less than 1 and not more than 5 carbon atoms, a halogen atom, an alkoxy group having not less than 1 and not more than 5 carbon atoms, a sulfonic group or a salt thereof, etc.

Examples of the preferred styrene-based compound include styrenes such as styrene, methyl styrene, α-methyl styrene, β-methyl styrene, tert-butyl styrene, chlorostyrene, chloromethyl styrene, methoxystyrene, styrenesulfonic acid or a salt thereof, etc. Of these styrene compounds, preferred are those compounds containing styrene, and more preferred is styrene.

The content of the styrene-based compound in the raw material vinyl monomer from which the constitutional unit of the vinyl-based resin segment (a2) is derived is preferably not less than 50% by mass, more preferably not less than 60% by mass and even more preferably not less than 70% by mass, and is also preferably not more than 95% by mass, more preferably not more than 90% by mass and even more preferably not more than 85% by mass, from the viewpoint of suppressing desorption and exposure of the releasing agent.

As the vinyl monomer other than the styrene-based compound, there may be mentioned at least one compound selected from the group consisting of (meth)acrylic acid esters such as alkyl ($C_1$ to $C_{24}$) (meth)acrylates, benzyl (meth)acrylate and dimethylaminoethyl (meth)acrylate; olefins such as ethylene, propylene and butadiene; halovinyl compounds such as vinyl chloride; vinyl esters such as vinyl acetate and vinyl propionate; vinyl ethers such as vinyl methyl ether; halogenated vinylidenes such as vinylidene chloride; and N-vinyl compounds such as N-vinyl pyrrolidone. Of these vinyl monomers other than the styrene-based compound, from the viewpoint of suppressing desorption and exposure of the releasing agent, preferred are (meth) acrylic acid esters, and more preferred are alkyl ($C_1$ to $C_{24}$) (meth)acrylates.

The number of carbon atoms of an alkyl group in the alkyl (meth)acrylates is preferably not less than 1, more preferably not less than 6, even more preferably not less than 8 and further even more preferably not less than 10 from the viewpoint of suppressing desorption and exposure of the releasing agent, and is also preferably not more than 24, more preferably not more than 22 and even more preferably not more than 20 from the viewpoint of improving availability of the monomers.

Specific examples of the alkyl (meth)acrylates include methyl (meth)acrylate, ethyl (meth)acrylate, (iso)propyl (meth)acrylate, (iso- or tertiary-)butyl (meth)acrylate, (iso) amyl (meth)acrylate, cyclohexyl (meth)acrylate, 2-ethylhexyl (meth)acrylate, (iso)octyl (meth)acrylate, (iso)decyl (meth)acrylate, (iso)dodecyl (meth)acrylate, (iso)palmityl (meth)acrylate, (iso)stearyl (meth)acrylate and (iso)behenyl (meth)acrylate. Of these alkyl (meth)acrylates, preferred is at least one compound selected from the group consisting of 2-ethylhexyl acrylate and stearyl methacrylate, and more preferred is 2-ethylhexyl acrylate or stearyl methacrylate.

Meanwhile, the terms "(iso- or tertiary-)" and "(iso)" as used herein mean both the structure in which the groups expressed by "(iso- or tertiary-)" and "(iso)" are present, and the structure in which these groups are not present (i.e., normal), and the term "(meth)acrylate" as used herein means an acrylate or a methacrylate.

Of these compounds, from the viewpoint of attaining good availability of the monomers and suppressing desorption and exposure of the releasing agent, preferred is styrene solely or a combination of styrene with the (meth)acrylic acid ester, more preferred is a combination of styrene with the (meth)acrylic acid ester, and even more preferred is a combination of styrene with the alkyl (meth)acrylate containing an alkyl group having not less than 8 and not more than 20 carbon atoms.

The content of the vinyl monomer other than the styrene-based compound in the raw material vinyl monomer from which the constitutional unit of the vinyl-based resin segment (a2) is derived is preferably not less than 5% by mass, more preferably not less than 10% by mass and even more preferably not less than 15% by mass, and is also preferably not more than 50% by mass, more preferably not more than 40% by mass and even more preferably not more than 30% by mass, from the viewpoint of suppressing desorption and exposure of the releasing agent.

When using a bireactive monomer as the raw material monomer for the composite resin, the bireactive monomer is reacted with both the polyester resin segment (a1) and the vinyl-based resin segment (a2), so that it is possible to suitably produce the composite resin. The constitutional unit derived from the bireactive monomer acts as a bonding point between the polyester resin segment (a1) and the vinyl-based resin segment (a2).

As the bireactive monomer, there may be used those vinyl monomers containing at least one functional group selected from the group consisting of a hydroxy group, a carboxy group, an epoxy group, a primary amino group and a secondary amino group in a molecule thereof. Of these vinyl monomers, from the viewpoint of improving the reactivity, preferred are vinyl monomers containing a hydroxy group and/or a carboxy group, and more preferred are vinyl monomers containing a carboxy group. Specific examples of the vinyl monomers containing a carboxy group include acrylic acid, methacrylic acid, fumaric acid and maleic acid. Of these vinyl monomers, from the viewpoint of improving reactivity of both the polycondensation reaction and addition polymerization reaction, preferred is at least one monomer selected from the group consisting of acrylic acid and methacrylic acid, and more preferred is acrylic acid.

From the viewpoint of improving dispersibility of the addition polymer containing the styrene-based compound as a constitutional unit thereof in the polyester resin and well controlling the addition polymerization reaction and polycondensation reaction, the bireactive monomer is used in an amount of preferably not less than 1 mole part, more preferably not less than 3 mole parts, even more preferably not less than 5 mole parts and further even more preferably not less than 8 mole parts, and also preferably not more than 30 mole parts, more preferably not more than 25 mole parts and even more preferably not more than 20 mole parts, on the basis of 100 mole parts of a total amount of the alcohol component as the raw material of the polyester resin segment (a1).

The total content of the styrene-based compound, the other vinyl monomer and the bireactive monomer in the components from which the constitutional units of the vinyl-based resin segment (a2) are derived, is preferably not less than 80% by mass, more preferably not less than 90% by mass, even more preferably not less than 95% by mass and further even more preferably 100% by mass from the viewpoint of suppressing desorption and exposure of the releasing agent.

<<Properties and the Like of Composite Resin>>

As described above, the composite resin contains the polyester resin segment (a1) and the vinyl-based resin segment (a2), and may further contain a constitutional segment derived from the aforementioned bireactive monomer, if required.

The content of the polyester resin segment (a1) in the composite resin is preferably not less than 40% by mass, more preferably not less than 45% by mass and even more preferably not less than 55% by mass, and is also preferably not more than 90% by mass, more preferably not more than 85% by mass and even more preferably not more than 80% by mass, from the viewpoint of suppressing desorption and exposure of the releasing agent.

The content of the vinyl-based resin segment (a2) in the composite resin is preferably not less than 5% by mass, more preferably not less than 10% by mass and even more preferably not less than 15% by mass from the viewpoint of suppressing desorption and exposure of the releasing agent, and is also preferably not more than 60% by mass, more preferably not more than 55% by mass and even more preferably not more than 45% by mass from the viewpoint of improving low-temperature fusing properties of the resulting toner.

The softening point of the composite resin is preferably not lower than 70° C., more preferably not lower than 75° C., even more preferably not lower than 80° C. and further even more preferably not lower than 85° C., and is also preferably not higher than 140° C., more preferably not higher than 135° C., even more preferably not higher than 130° C. and further even more preferably not higher than 125° C., from the viewpoint of suppressing desorption and exposure of the releasing agent and obtaining a toner that is excellent in solid-image followup ability upon printing.

The glass transition temperature of the composite resin is preferably not lower than 30° C., more preferably not lower than 35° C. and even more preferably not lower than 40° C., and is also preferably not higher than 75° C., more preferably not higher than 70° C. and even more preferably not higher than 65° C., from the same viewpoint as described above.

The acid value of the composite resin is preferably not less than 5 mgKOH/g, more preferably not less than 10 mgKOH/g and even more preferably not less than 12 mgKOH/g, and is also preferably not more than 40 mgKOH/g, more preferably not more than 35 mgKOH/g and even more preferably not more than 30 mgKOH/g, from the viewpoint of improving dispersion stability of the resin particles (A) containing the composite resin in the aqueous medium as well as from the viewpoint of suppressing desorption and exposure of the releasing agent and obtaining a toner that is excellent in solid-image followup ability upon printing.

The composite resin may be used alone or in combination of any two or more kinds thereof.

Meanwhile, when the composite resin is used in the form of a mixture of two or more kinds of composite resins, the softening point, the glass transition temperature and the acid value of the composite resin as defined in the present invention mean a softening point, a glass transition temperature and an acid value of the mixture of the composite resins, respectively, as measured by the methods described in Examples below.

<<Method of Producing Composite Resin>>

The composite resin is preferably produced by any of the following methods (i) to (iii). Meanwhile, the bireactive monomer is preferably supplied together with the raw material monomer for the vinyl-based resin component to the reaction system, from the viewpoint of improving the reactivity. In addition, from the viewpoint of improving the reactivity, there may be used a catalyst such as an esterification catalyst and an esterification co-catalyst. Furthermore, there may also be used a polymerization initiator and a polymerization inhibitor.

(i) Method in which the step of the polycondensation reaction between the alcohol component and the carboxylic acid component (hereinafter also referred to as "step (A)") is followed by the step of an addition polymerization reaction of the raw material monomer for the vinyl-based resin component and, if required, the bireactive monomer (hereinafter also referred to as "step (B)").

Meanwhile, there may also be used such a method in which after subjecting a part of the carboxylic acid component to the polycondensation reaction in the step (A) and then conducting the step (B), the reaction temperature is raised again, and a remaining part of the carboxylic acid component is added to the polymerization reaction system to allow the polycondensation reaction in the step (A) and, if required, the reaction with the bireactive monomer to further proceed.

(ii) Method in which the step (B) of the addition polymerization reaction of the raw material monomer for the vinyl-based resin component and the bireactive monomer is followed by the step (A) of the polycondensation reaction of the raw material monomer for the polyester resin component.

(iii) Method in which the step (A) of the polycondensation reaction of the alcohol component and the carboxylic acid component and the step (B) of the addition polymerization reaction of the raw material monomer for the vinyl-based resin component and the bireactive monomer are conducted in parallel with each other.

Of these methods, the method (i) is preferred because the polycondensation reaction temperature can be selected with a high degree of freedom.

The aforementioned methods (i) to (iii) are preferably conducted in the same reaction vessel.

The temperature used in the polycondensation reaction is preferably not lower than 180° C. and more preferably not lower than 200° C., and is also preferably not higher than 260° C. and more preferably not higher than 250° C., from the viewpoint of enhancing productivity of the composite resin.

It is also preferred that the reaction system is held under reduced pressure in a later stage of the polycondensation reaction to promote the reaction.

The temperature used in the addition polymerization reaction may vary depending upon the kind of polymerization initiator used, and is preferably not lower than 110° C. and more preferably not lower than 130° C., and is also preferably not higher than 220° C. and more preferably not higher than 210° C., from the viewpoint of enhancing productivity of the composite resin.

Examples of the esterification catalyst suitably used in the polycondensation reaction include tin compounds such as dibutyl tin oxide and tin (II) di(2-ethyl hexanoate), and titanium compounds such as titanium diisopropylate bistriethanol aminate. Of these esterification catalysts, preferred are tin compounds, and more preferred is tin (II) di(2-ethyl hexanoate).

The amount of the esterification catalyst used is not particularly limited, and is preferably not less than 0.01 part by mass, more preferably not less than 0.1 part by mass and even more preferably not less than 0.3 part by mass, and is also preferably not more than 5 parts by mass, more preferably not more than 2 parts by mass and even more preferably not more than 1 part by mass, on the basis of 100 parts by mass of a total amount of the alcohol component and the carboxylic acid component.

Examples of the esterification co-catalyst include pyrogallol compounds such as pyrogallol, gallic acid (same as 3,4,5-trihydroxybenzoic acid) and gallic acid esters; benzophenone derivatives such as 2,3,4-trihydroxybenzophenone and 2,2',3,4-tetrahydroxybenzophenone; and catechin derivatives such as epigallocatechin and epigallocatechin gallate. Of these esterification co-catalysts, gallic acid is preferred from the viewpoint of improving the reactivity.

The amount of the esterification co-catalyst used in the polycondensation reaction is preferably not less than 0.001 part by mass, more preferably not less than 0.01 part by mass and even more preferably not less than 0.03 part by mass, and is also preferably not more than 0.5 part by mass, more preferably not more than 0.2 part by mass and even more preferably not more than 0.1 part by mass, on the basis of 100 parts by mass of a total amount of the alcohol component and the carboxylic acid component, from the viewpoint of improving the reactivity.

Examples of the radical polymerization inhibitor used in the polycondensation reaction include 4-tert-butyl catechol, etc. The amount of the radical polymerization inhibitor used in the polycondensation reaction is preferably not less than 0.001 part by mass and more preferably not less than 0.005 part by mass, and is also preferably not more than 0.5 part by mass and more preferably not more than 0.1 part by mass, on the basis of 100 parts by mass of a total amount of the alcohol component and the carboxylic acid component.

Examples of the polymerization initiator used in the addition polymerization reaction include conventionally known radical polymerization initiators, e.g., peroxides such as dibutyl peroxide, persulfates such as sodium persulfate and azo compounds such as 2,2'-azobis(2,4-dimethyl valeronitrile), etc.

The amount of the radical polymerization initiator used in the addition polymerization reaction is preferably not less than 1 part by mass and more preferably not less than 3 parts by mass, and is also preferably not more than 20 parts by mass and more preferably not more than 15 parts by mass, on the basis of 100 parts by mass of the raw material monomer for the vinyl-based resin segment (a2).

(Optional Components of Resin Particles (A))

As the resin constituting the resin particles (A), in addition to the aforementioned composite resin, there may also be used conventionally known resins ordinarily used for production of toners, for example, such as a polyester resin, a styrene-acrylic copolymer, an epoxy resin, a polycarbonate and a polyurethane.

(Water Dispersion of Resin Particles (A) and Method of Producing Water Dispersion of Resin Particles (A))

The water dispersion of the resin particles (A) is in the form of a dispersion prepared by dispersing the aforementioned resin particles (A) in an aqueous medium. The resin particles (A) may be suitably produced by mixing the aforementioned composite resin, if required, together with a surfactant and the aforementioned optional components, in the aqueous medium.

As the method of producing the water dispersion of the resin particles (A), there may be used a method of adding the composite resin and the like to the aqueous medium and subjecting the resulting mixture to dispersion treatment using a disperser or the like, a method of gradually adding the aqueous medium to the composite resin and the like to subject the resulting mixture to phase inversion emulsification, etc. Among these methods, the method using phase inversion emulsification is preferred.

[Phase Inversion Emulsification]

As the method of performing the phase inversion emulsification, there may be mentioned a method of adding the aqueous medium to a solution prepared by dissolving the composite resin and the aforementioned other optional components in an organic solvent to subject the resulting solution to phase inversion emulsification (hereinafter also referred to merely as a "method (1-1)"), and a method of adding the aqueous medium to a resin mixture prepared by melting and mixing the composite resin and the aforementioned other optional components to subject the resulting mixture to phase inversion emulsification (hereinafter also referred to merely as a "method (1-2)").

According to the phase inversion emulsification method, the water dispersion of the resin particles (A) can be produced without using any surfactant, and it is therefore possible to suppress desorption and exposure of the releasing agent and improve solid-image followup ability of the resulting toner.

In the present invention, when producing the resin particles (A) in the form of a water dispersion thereof, from the viewpoint of improving dispersion stability of the releasing agent particles by effectively utilizing a good dispersion stabilizing effect of the resin particles (A), from the viewpoint of obtaining uniform aggregated particles in the subsequent aggregating step and from the viewpoint of suppressing desorption of the releasing agent from the aggregated particles, it is preferred that the production method is conducted under the conditions in which no surfactant is used. However, from the viewpoint of improving dispersion stability of the water dispersion of the resin particles (A), the surfactant may also be used in such a range that the advantageous effects of the present invention are not adversely affected.

Since the resin particles (A) may act as a dispersant for the releasing agent, among the aforementioned methods, the method (1-1) is preferably used from the viewpoint of facilitating production of a more homogeneous water dispersion of the resin particles (A) even without using any surfactant.

In the following, the aqueous medium and the surfactant are first described, and then the method of producing the water dispersion of the resin particles (A) by the phase inversion emulsification method is described.

[Aqueous Medium]

The aqueous medium used for producing the water dispersion of the resin particles (A) preferably contains water as a main component. From the viewpoint of improving dispersion stability of the water dispersion of the resin particles (A) and attaining good environmental suitability, the content of water in the aqueous medium is preferably not less than 80% by mass, more preferably not less than 90% by mass, even more preferably not less than 95% by mass, further even more preferably not less than 98% by mass and still further even more preferably 100% by mass. As the water, deionized water or distilled water is preferably used.

Examples of components other than water which may be contained in the aqueous medium include water-soluble organic solvents, e.g., alkyl alcohols having not less than 1 and not more than 5 carbon atoms; dialkyl ketones having not less than 3 and not more than 5 carbon atoms, such as acetone and methyl ethyl ketone; and cyclic ethers such as tetrahydrofuran. Of these organic solvents, from the viewpoint of preventing inclusion of the organic solvents into the resulting toner, preferred are alkyl alcohols having not less than 1 and not more than 5 carbon atoms which are incapable of dissolving the polyester resin therein, and more preferred are methanol, ethanol, isopropanol and butanol.

[Surfactant]

Examples of the surfactant include a nonionic surfactant, an anionic surfactant and a cationic surfactant. Of these surfactants, preferred is a nonionic surfactant. The nonionic surfactant is more preferably used in combination with the anionic surfactant or the cationic surfactant. From the viewpoint of improving dispersion stability of the water dispersion of the resin particles, the nonionic surfactant is even more preferably used in combination with the anionic surfactant.

When using the nonionic surfactant in combination with the anionic surfactant, the mass ratio of the nonionic surfactant to the anionic surfactant (nonionic surfactant/anionic surfactant) is preferably not less than 0.3 and more preferably not less than 0.5, and is also preferably not more than 10, more preferably not more than 5 and even more preferably not more than 2, from the viewpoint of improving dispersion stability of the water dispersion of the resin particles.

Examples of the nonionic surfactant include polyoxyethylene alkyl or alkenyl ethers, polyoxyethylene alkyl aryl ethers, polyoxyethylene fatty acid esters and oxyethylene/oxypropylene block copolymers.

Specific examples of the polyoxyethylene alkyl or alkenyl ethers include polyoxyethylene oleyl ether and polyoxyethylene lauryl ether.

Specific examples of the polyoxyethylene alkyl aryl ethers include polyoxyethylene nonyl phenyl ether.

Specific examples of the polyoxyethylene fatty acid esters include polyethylene glycol monolaurate, polyethylene glycol monostearate and polyethylene glycol monooleate.

Of these nonionic surfactants, from the viewpoint of improving dispersion stability of the water dispersion of the resin particles, preferred are the polyoxyethylene alkyl or alkenyl ethers, and more preferred is polyoxyethylene lauryl ether.

Examples of the anionic surfactant include alkylbenzenesulfonic acid salts, alkylsulfuric acid salts and alkylethersulfuric acid salts. Of these anionic surfactants, preferred are alkylbenzenesulfonic acid salts and alkylethersulfuric acid salts, from the viewpoint of improving dispersion stability of the water dispersion of the resin particles.

As the alkylbenzenesulfonic acid salts, preferred are alkylbenzenesulfonic acid alkali metal salts, and more preferred are sodium alkylbenzenesulfonates. As the alkyl group in the alkylbenzenesulfonic acid salts, a dodecyl group is preferred. As the alkylbenzenesulfonic acid salts, preferred are dodecylbenzenesulfonic acid salts, more preferred are dodecylbenzenesulfonic acid alkali metal salts, and even more preferred is sodium dodecylbenzenesulfonate.

As the alkylsulfuric acid salts, preferred are alkylsulfuric acid alkali metal salts, and more preferred are sodium alkylsulfates. As the alkyl group in the alkylsulfuric acid salts, a dodecyl group is preferred. As the alkylsulfuric acid salts, preferred are dodecylsulfuric acid alkali metal salts, and more preferred is sodium dodecylsulfate.

As the alkylethersulfuric acid salts, preferred are alkylethersulfuric acid alkali metal salts, and more preferred are sodium alkylethersulfates. As the alkyl group in the alkylethersulfuric acid salts, a dodecyl group is preferred. As the alkylethersulfuric acid salts, preferred are dodecylethersulfuric acid salts, more preferred are dodecylethersulfuric acid alkali metal salts, and even more preferred is sodium dodecylethersulfate.

The cationic surfactant is preferably in the form of a quaternary ammonium salt. Specific examples of the cationic surfactant include alkylbenzyldimethyl ammonium chlorides, alkyltrimethyl ammonium chlorides and the like.

The surfactant is preferably not used from the viewpoint of suppressing desorption of the releasing agent from the aggregated particles. From the same viewpoint as described above, the amount of the surfactant used is preferably not more than 20 parts by mass, more preferably not more than 10 parts by mass, even more preferably not more than 5 parts by mass and further even more preferably not more than 2 parts by mass on the basis of 100 parts by mass of the resin constituting the resin particles (A).

However, if it is necessary to use the surfactant by the reason for further improving dispersion stability of the water dispersion of the resin particles (A), etc., the amount of the surfactant used is preferably not less than 0.1 part by mass, more preferably not less than 0.5 part by mass and even more preferably not less than 1 part by mass on the basis of 100 parts by mass of the resin constituting the resin particles (A).

<<Method (1-1)>>

In the method (1-1), the composite resin and the aforementioned other optional components are first dissolved in an organic solvent to prepare an organic solvent solution of a mixture containing the composite resin and the other optional components, and then the aqueous medium is added to the thus obtained organic solvent solution to subject the solution to phase inversion emulsification.

<<Organic Solvent>>

The organic solvent used in the aforementioned method preferably has a solubility parameter (SP value: refer to "Polymer Handbook, Third Edition", published in 1989 by John Wiley & Sons, Inc.) of not less than 15.0 $MPa^{1/2}$, more preferably not less than 16.0 $MPa^{1/2}$ and even more preferably not less than 17.0 $MPa^{1/2}$, and also preferably not more than 26.0 $MPa^{1/2}$, more preferably not more than 24.0 $MPa^{1/2}$ and even more preferably not more than 22.0 $MPa^{1/2}$, from the viewpoint of facilitating dissolution of the composite resin and phase inversion thereof in the aqueous medium.

Specific examples of the organic solvent used above are as follows. Meanwhile, the numeral values in parentheses appearing on the right side of the respective names of the following organic solvents indicate SP values thereof, and a unit of the SP values is $MPa^{1/2}$. That is, specific examples of the organic solvent include alcohol solvents such as ethanol (26.0), isopropanol (23.5) and isobutanol (21.5); ketone solvents such as acetone (20.3), methyl ethyl ketone (19.0), methyl isobutyl ketone (17.2) and diethyl ketone (18.0); ether solvents such as dibutyl ether (16.5), tetrahydrofuran (18.6) and dioxane (20.5); and acetic acid ester solvents such as ethyl acetate (18.6) and isopropyl acetate (17.4). Of these organic solvents, from the viewpoint of facilitating removal of the organic solvents from the mixed solution obtained after adding the aqueous medium thereto, preferred is at least one solvent selected from the group consisting of ketone solvents and acetic acid ester solvents, more preferred is at least one solvent selected from the group consisting of methyl ethyl ketone, ethyl acetate and isopropyl acetate, and even more preferred is methyl ethyl ketone.

The mass ratio of the organic solvent to the components constituting the resin particles (A) (organic solvent/resin particles (A)) is preferably not less than 0.1, more preferably not less than 0.5 and even more preferably not less than 0.8, and is also preferably not more than 4, more preferably not more than 3 and even more preferably not more than 2, from the viewpoint of facilitating dissolution of the composite resin and phase inversion thereof in the aqueous medium as well as from the viewpoint of improving dispersion stability of the resin particles (A).

In the method (1-1), it is preferable to add a neutralizing agent to the solution. As the neutralizing agent, there may be used a basic substance. Examples of the basic substance include hydroxides of alkali metals such as lithium hydroxide, sodium hydroxide and potassium hydroxide; and nitrogen-containing basic substances such as ammonia, trimethyl amine, ethyl amine, diethyl amine, triethyl amine, diethanol amine, triethanol amine and tributyl amine. Of these basic substances, from the viewpoint of improving dispersion stability and aggregating properties of the resin particles (A), preferred are hydroxides of alkali metals, and more preferred are sodium hydroxide and potassium hydroxide.

The degree (mol %) of neutralization of the composite resin with the neutralizing agent is preferably not less than 10 mol % and more preferably not less than 30 mol %, and is also preferably not more than 150 mol %, more preferably not more than 120 mol % and even more preferably not more than 100 mol %.

Meanwhile, the degree (mol %) of neutralization of the composite resin may be determined according to the following formula.

Degree of neutralization={[mass (g) of neutralizing agent added/equivalent of neutralizing agent]/[acid value of composite resin (mgKOH/g)× mass (g) of resin/(56×1000)]}×100.

The amount of the aqueous medium added is preferably not less than 100 parts by mass, more preferably not less than 200 parts by mass and even more preferably not less than 300 parts by mass, and is also preferably not more than 900 parts by mass, more preferably not more than 800 parts by mass and even more preferably not more than 600 parts by mass, on the basis of 100 parts by mass of the resin constituting the resin particles (A), from the viewpoint of improving dispersion stability of the resin particles (A) and obtaining uniform aggregated particles in the subsequent aggregating step.

The temperature used upon adding the aqueous medium is preferably not lower than a glass transition temperature of the resin, from the viewpoint of improving dispersion stability of the resin particles (A). More specifically, the temperature used upon adding the aqueous medium is preferably not lower than 30° C., more preferably not lower than 50° C. and even more preferably not lower than 60° C., and is also preferably not higher than 85° C., more preferably not higher than 80° C. and even more preferably not higher than 75° C., from the viewpoint of improving dispersion stability of the resin particles (A).

From the viewpoint of obtaining the resin particles (A) having a small particle size, the velocity of addition of the aqueous medium until terminating the phase inversion is preferably not less than 0.1 part by mass/minute, more preferably not less than 0.5 part by mass/minute, even more preferably not less than 1 part by mass/minute and further even more preferably not less than 5 parts by mass/minute, and is also preferably not more than 50 parts by mass/minute, more preferably not more than 30 parts by mass/minute, even more preferably not more than 20 parts by mass/minute and further even more preferably not more than 10 parts by mass/minute, on the basis of 100 parts by mass of the resin constituting the resin particles (A). However, the velocity of addition of the aqueous medium after terminating the phase inversion is not particularly limited.

After completion of the phase inversion emulsification, the step of removing the organic solvent from the dispersion obtained by the phase inversion emulsification may be conducted, if required.

The method of removing the organic solvent is not particularly limited, and any optional method may be used to remove the organic solvent from the dispersion. However, since the organic solvent is dissolved in the aqueous medium, the dispersion is preferably subjected to distillation to remove the organic solvent therefrom. In addition, it is not necessarily required to completely remove the organic solvent from the water dispersion, and a small amount of the organic solvent may remain in the water dispersion. In this case, the amount of the organic solvent remaining in the water dispersion is preferably not more than 1% by mass, more preferably not more than 0.5% by mass and even more preferably substantially 0%.

Meanwhile, the term "substantially 0%" as used herein means that the amount of the organic solvent remaining in the water dispersion of the resin particles is not more than 0.01% by mass. The amount of the organic solvent remaining in the water dispersion of the resin particles is more preferably not more than 0.001% by mass.

When removing the organic solvent by distillation, the dispersion is preferably heated to a temperature not lower than a boiling point of the organic solvent used while stirring to thereby distil off the organic solvent therefrom. In addition, from the viewpoint of maintaining good dispersion stability of the resin particles (A), the dispersion is more preferably heated under reduced pressure to a temperature not lower than a boiling point of the organic solvent used under the reduced pressure to distil off the organic solvent therefrom. Meanwhile, the dispersion may be heated after reducing the pressure, or the pressure may be reduced after heating the dispersion. From the viewpoint of maintaining good dispersion stability of the resin particles (A), the organic solvent is preferably distilled off from the dispersion under constant temperature and constant pressure conditions.

<<Method (1-2)>>

The method (1-2) is a method of adding the aqueous medium to a resin mixture prepared by melting and mixing the resin and, if required, the aforementioned other optional components to subject the resulting mixture to phase inversion emulsification.

In the method (1-2), first, the resin and, if required, the surfactant and the aforementioned other optional components, are melted and mixed to obtain the resin mixture.

When the resin includes a plurality of resins, a mixture obtained by previously mixing the plurality of resins may be used. Alternatively, the plurality of resins may be added simultaneously with addition of the other components, and then the resulting mixture may be melted and mixed to obtain the resin mixture.

As the method of obtaining the resin mixture, there is preferably used the method in which the resin as well as, if required, the surfactant, the aforementioned other optional components and the neutralizing agent, are charged into a reaction vessel, and then while stirring the contents of the reaction vessel using a stirrer, the resin is melted and uniformly mixed therein.

The preferred forms of the neutralizing agent used in the method (1-2) are the same as those used in the aforementioned method (1-1).

The temperature used upon melting and mixing the resin is preferably not lower than a glass transition temperature of the resin and also preferably not higher than a boiling point of the aqueous medium from the viewpoint of obtaining homogeneous resin particles. More specifically, the temperature used upon melting and mixing the resin is preferably not lower than 70° C., more preferably not lower than 80° C. and even more preferably not lower than 90° C., and is also preferably not higher than 100° C. and more preferably not higher than 98° C.

Next, the aqueous medium is added to the aforementioned resin mixture, and the resulting mixture is subjected to phase inversion emulsification to thereby obtain the water dispersion of the resin particles (A).

The temperature used upon adding the aqueous medium is preferably not lower than a glass transition temperature of the resin and also preferably not higher than a boiling point of the aqueous medium from the viewpoint of obtaining homogeneous resin particles. More specifically, the temperature used upon adding the aqueous medium is preferably not lower than 70° C., more preferably not lower than 80° C. and even more preferably not lower than 90° C., and is also preferably not higher than 100° C. and more preferably not higher than 98° C.

A suitable amount of the aqueous medium used and a suitable velocity of addition of the aqueous medium are the same as those used in the aforementioned method (1-1).

[Properties and the Like of Water Dispersion of Resin Particles (A)]

The solid content of the water dispersion of the resin particles (A) which is obtained by the phase inversion emulsification is preferably not less than 5% by mass, more preferably not less than 10% by mass and even more preferably not less than 15% by mass, and is also preferably not more than 50% by mass, more preferably not more than 40% by mass, even more preferably not more than 30% by mass and further even more preferably not more than 25% by mass, from the viewpoint of enhancing productivity of the toner and improving dispersion stability of the water dispersion of the resin particles (A).

Meanwhile, the solid content means a total content of non-volatile components in the water dispersion.

The volume average particle size ($D_v$) of the resin particles (A) in the water dispersion is preferably not less than 0.02 μm, more preferably not less than 0.03 μm and even more preferably not less than 0.04 μm, and is also preferably not more than 1.00 μm, more preferably not more than 0.50 μm, even more preferably not more than 0.20 μm, further even more preferably not more than 0.10 μm, still further even more preferably not more than 0.09 μm and still further even more preferably not more than 0.08 μm, from the viewpoint of obtaining a toner capable of forming high quality images. Meanwhile, the volume average particle size ($D_v$) may be determined by the method described in Examples below.

(Production of Water Dispersion of Releasing Agent Particles)

The water dispersion of the releasing agent particles is obtained by mixing the aforementioned releasing agent and the aforementioned water dispersion of the resin particles (A), if required, together with the aqueous medium.

Since in the step (1), the releasing agent particles are produced by using the releasing agent and the resin particles (A), the releasing agent can be dispersed in the aqueous medium owing to an adequate polarity of the polyester resin segment (a1) without using any particular surfactant.

The water dispersion of the releasing agent particles is preferably obtained by dispersing the releasing agent and the resin particles (A), if required, together with the aqueous medium, at a temperature not lower than a melting point of the releasing agent using a disperser. As the disperser, there are preferably used a homogenizer, a high-pressure disperser, an ultrasonic disperser, etc., from the viewpoint of widening a temperature range in which the resulting toner can be fused and improving durability of the toner. Of these dispersers, more preferred is an ultrasonic disperser. The dispersing time may be appropriately determined according to the disperser used.

As the ultrasonic disperser, there may be used, for example, an ultrasonic homogenizer. Examples of commercially available devices of the ultrasonic homogenizer include "US-150T", "US-300T" and "US-600T" all available from Nihonseiki Kaisha Ltd., and "SONIFIER 4020-400" and "SONIFIER 4020-800" both available from Branson Corporation.

In addition, before using the aforementioned disperser, the releasing agent and the water dispersion of the resin particles (A), if required, together with the aqueous medium may be subjected to preliminary dispersion treatment using a mixer such as a homomixer and a ball mill.

The preferred forms of the aqueous medium used in the production process of the present invention are the same as those of the aqueous medium used upon obtaining the resin particles (A).

From the viewpoint of improving dispersion stability of the releasing agent particles, suppressing desorption and exposure of the releasing agent, obtaining uniform aggregated particles in the subsequent aggregating step, and incorporating the releasing agent into the toner even after heating in the coalescing step, the mass ratio of the releasing agent to the resin particles (A) [releasing agent/resin particles (A)] is preferably from 100/1 to 100/100, more preferably from 100/10 to 100/60, even more preferably from 100/20 to 100/50 and further even more preferably from 100/25 to 100/45.

From the viewpoint of suppressing desorption and exposure of the releasing agent and obtaining a toner that is excellent in solid-image followup ability upon printing, it is preferred that the water dispersion of the releasing agent particles contains no surfactant. However, the water dispersion of the releasing agent particles may contain the surfactant to such an extent that the advantageous effects of the present invention are not adversely affected by inclusion of the surfactant therein.

From the same viewpoint as described above, in the case where the water dispersion of the releasing agent particles contains the surfactant, the content of the surfactant in the water dispersion of the releasing agent particles is preferably not more than 1 part by mass, more preferably not more than 0.5 part by mass and even more preferably not more than 0.1 part by mass on the basis of 100 parts by mass of the releasing agent in the releasing agent particles. Also, in the case where the surfactant is used in order to improve dispersion stability of the releasing agent particles in the water dispersion, the content of the surfactant in the water dispersion of the releasing agent particles is preferably not less than 0.01 part by mass, more preferably not less than 0.02 part by mass and even more preferably not less than 0.05 part by mass on the basis of 100 parts by mass of the releasing agent in the releasing agent particles.

In the step (1), the releasing agent and the resin particles (A) are preferably added to the aqueous medium, and the resulting mixture is dispersed while heating at a temperature not lower than a melting point of the releasing agent.

More specifically, the heating temperature upon dispersing the mixture is preferably a temperature not lower than a melting point of the releasing agent and not lower than 80° C., more preferably not lower than 85° C. and even more preferably not lower than 90° C., and is also preferably not higher than 100° C., more preferably not higher than 98° C. and even more preferably not higher than 95° C., from the viewpoint of enhancing productivity of the water dispersion of the releasing agent particles.

Also, the heating time upon dispersing the mixture is preferably not less than 5 minutes, more preferably not less than 10 minutes and even more preferably not less than 15 minutes, and is also preferably not more than 3 hours, more preferably not more than 2 hours and even more preferably not more than 1 hour, from the viewpoint of enhancing productivity of the water dispersion of the releasing agent particles.

The solid content of the water dispersion of the releasing agent particles is preferably not less than 5% by mass, more preferably not less than 10% by mass and even more preferably not less than 15% by mass, and is also preferably not more than 40% by mass, more preferably not more than 30% by mass and even more preferably not more than 25% by mass, from the viewpoint of improving dispersion stability of the releasing agent particles, facilitating handling of the water dispersion of the releasing agent particles and enhancing productivity of the toner.

The volume median particle size ($D_{50}$) of the releasing agent particles is preferably not less than 0.05 μm, more preferably not less than 0.20 μm, even more preferably not less than 0.40 μm and further even more preferably not less than 0.45 μm, and is also preferably not more than 1.00 μm, more preferably not more than 0.80 μm, even more preferably not more than 0.70 μm, further even more preferably not more than 0.65 μm and still further even more preferably not more than 0.60 μm, from the viewpoint of obtaining uniform aggregated particles in the subsequent aggregating step, suppressing desorption and exposure of the releasing agent and obtaining a toner that is excellent in solid-image followup ability upon printing.

The ratio of the volume median particle size ($D_{50}$) of the releasing agent particles to the volume average particle size ($D_v$) of the resin particles (A) [volume median particle size ($D_{50}$) of releasing agent particles/volume average particle size ($D_v$) of resin particles (A)] is preferably not less than 1.0, more preferably not less than 3.0 and even more preferably not less than 5.0, and is also preferably not more than 50, more preferably not more than 30, even more preferably not more than 15, further even more preferably not more than 12, still further even more preferably not more than 10 and still further even more preferably not more than 8.5, from the viewpoint of improving dispersion stability of the releasing agent particles, suppressing desorption and exposure of the releasing agent, and obtaining a toner that is excellent in solid-image followup ability upon printing.

<Step (2)>

In the step (2), the water dispersion of the releasing agent particles obtained in the step (1) is mixed with a water dispersion of resin particles (B) to aggregate the releasing agent particles with the resin particles (B), thereby obtaining aggregated particles.

The amount of the releasing agent particles used in the step (2) is preferably not less than 0.1 part by mass, more preferably not less than 0.5 part by mass, even more preferably not less than 1 part by mass and further even more preferably not less than 3 parts by mass, and is also preferably not more than 15 parts by mass, more preferably not more than 10 parts by mass, even more preferably not more than 8 parts by mass and further even more preferably not more than 6 parts by mass, on the basis of 100 parts by mass of a whole amount of the resin particles (B) used in the step (2), from the viewpoint of suppressing desorption and exposure of the releasing agent and obtaining a toner that is excellent in solid-image followup ability upon printing.

In addition, the step (2) may also include the following step (2A), and may further include the following step (2B) subsequent to the step (2A);

step (2A); mixing the water dispersion of the releasing agent particles obtained in the step (1), the water dispersion of the resin particles (B) and an aggregating agent with each other in an aqueous medium to obtain aggregated particles (1); and then step (2B); adding the resin particles (B) to the aggregated particles (1) obtained in the step (2A) at one time or plural times in a split addition manner to obtain aggregated particles (2) formed by adhering the resin particles (B) onto the aggregated particles (1) (resin particle (B)-adhered aggregated particles).

Meanwhile, in the step (2), in particular, in the step (2A), a colorant may be added. Also, the resin particles (B) added in the step (2A) may be referred to as resin particles (B1) in some cases, whereas the resin particles (B) added in the step (2B) may be referred to as resin particles (B2) in some cases.

(Resin Particles (B))

The resin particles (B) have a function as a resin binder for the toner.

The resin particles (B) used in the present invention contain a segment (b1) constituted of a polyester resin in an amount of not less than 50% by mass from the viewpoint of suppressing desorption and exposure of the releasing agent and obtaining a toner that is excellent in solid-image followup ability.

Similarly to the resin particles (B) forming a resin binder as a base material of the toner, by incorporating the polyester resin segment (a1) into the resin particles (A) functioning as a dispersant for the releasing agent, it is possible to enhance affinity between the releasing agent particles obtained in the step (1) and the resin particles (B). In addition, since the releasing agent particles contain no surfactant or merely a less amount of the surfactant, the releasing agent is unlikely to be desorbed from the aggregated particles even after aggregating the releasing agent particles and the resin particles (B). Furthermore, it is considered that since exposure of the releasing agent to the surface of the toner is suppressed, the toner can be improved in solid-image followup ability upon printing.

[Resin Constituting Resin Particles (B)]

From the viewpoint of suppressing desorption and exposure of the releasing agent and obtaining a toner that is excellent in solid-image followup ability, the resin particles (B) contain the segment (b1) constituted of a polyester resin in an amount of not less than 50% by mass. More specifically, the resin constituting the resin particles (B) may contain a polyester resin in an amount of not less than 50% by mass, or may contain a composite resin containing the polyester resin segment (b1) in an amount of not less than 50% by mass. Thus, the resin constituting the resin particles (B) may contain a moiety corresponding to a polyester in an amount of not less than 50% by mass.

From the viewpoint of suppressing desorption and exposure of the releasing agent and obtaining a toner that is excellent in solid-image followup ability upon printing, the content of the polyester resin segment (b1) in the resin constituting the resin particles (B) is not less than 50% by mass, preferably not less than 55% by mass, more preferably not less than 58% by mass and even more preferably not less than 60% by mass.

As the resin constituting the resin particles (B), in addition to the polyester resin, there may also be used known resins used for the toner, for example, such as a styrene-acrylic copolymer, an epoxy resin, a polycarbonate, a polyurethane, etc. In addition, as the resin constituting the resin particles (B), there may also be used the composite resin containing the aforementioned polyester resin segment (a1) and vinyl-based resin segment (a2).

The content of the resin in the resin particles (B) is preferably not less than 80% by mass, more preferably not less than 90% by mass and even more preferably not less than 95% by mass from the viewpoint of suppressing desorption and exposure of the releasing agent and obtaining a toner that is excellent in solid-image followup ability upon printing, and is also preferably not more than 100% by mass, more preferably not more than 99% by mass and even more preferably not more than 98% by mass from the viewpoint of improving dispersion stability of the water dispersion of the resin particles.

From the viewpoint of suppressing desorption and exposure of the releasing agent and obtaining a toner that is excellent in solid-image followup ability upon printing, the total content of the polyester resin and the aforementioned composite resin in the resin constituting the resin particles (B) is preferably not less than 80% by mass, more preferably not less than 90% by mass, even more preferably not less than 95% by mass, further even more preferably not less than 98% by mass and still further even more preferably 100% by mass.

In the case where the composite resin is used as the resin constituting the resin particles (B), the details of the composite resin that can be used as the resin constituting the resin particles (B) are the same as those described with respect to the composite resin constituting the resin particles (A). The composite resin that can be used for the resin particles (B) may be the same composite resin as used for the resin particles (A) or may be a composite resin different therefrom.

<<Polyester Resin>>

In the case where a polyester resin is used as the resin constituting the resin particles (B), the raw material monomers constituting the polyester resin include an alcohol component and an acid component. The alcohol component and acid component used in the polyester resin may be an optional alcohol component and an optional carboxylic acid component, respectively.

Examples of the carboxylic acid component include an aliphatic dicarboxylic acid, an aromatic dicarboxylic acid, a trivalent or higher-valent polycarboxylic acid, and an anhydride and an alkyl (having not less than 1 and not more than 3 carbon atoms) ester of these acids.

Examples of the aliphatic dicarboxylic acid suitably used are the same acids as the acid components constituting the aforementioned segment (a1). Of these aliphatic dicarboxylic acids, preferred is at least one acid selected from the group consisting of fumaric acid, adipic acid, a substituted succinic acid containing an alkenyl group having not less than 2 and not more than 20 carbon atoms as a substituent group, sebacic acid, succinic acid and an anhydride of these acids, and more preferred is at least one acid selected from the group consisting of fumaric acid, adipic acid, and an anhydride of the substituted succinic acid containing an alkenyl group having not less than 2 and not more than 20 carbon atoms as a substituent group.

Examples of the aromatic dicarboxylic acid include phthalic acid, isophthalic acid and terephthalic acid. Of these aromatic dicarboxylic acids, from the viewpoint of improving durability and charging properties of the resulting toner, preferred are the aromatic dicarboxylic acids, and more preferred is terephthalic acid.

Examples of the trivalent or higher-valent polycarboxylic acid include aromatic polycarboxylic acids. Specific examples of the trivalent or higher-valent aromatic polycarboxylic acid include trimellitic acid, 2,5,7-naphthalene-tricarboxylic acid and pyromellitic acid. Of these trivalent or higher-valent aromatic polycarboxylic acids, from the viewpoint of improving low-temperature fusing properties and durability of the resulting toner, preferred are trimellitic acid and trimellitic anhydride, and more preferred is trimellitic anhydride.

These carboxylic acid components may be used alone or in combination of any two or more thereof.

The content of the aliphatic dicarboxylic acid component in the acid component constituting the polyester resin is preferably not less than 10% by mass, more preferably not less than 15% by mass and even more preferably not less than 20% by mass from the viewpoint of suppressing desorption and exposure of the releasing agent and obtaining a toner that is excellent in solid-image followup ability upon printing, and is also preferably not more than 97% by mass, more preferably not more than 95% by mass and even more preferably not more than 93% by mass from the viewpoint of improving durability of the resulting toner.

Examples of the alcohol component include aromatic diols, aliphatic diols having not less than 2 and not more than 12 main-chain carbon atoms, alicyclic diols, trivalent or higher-valent polyhydric alcohols, and alkylene (having not less than 2 and not more than 4 carbon atoms) oxide adducts (average molar number of addition of alkyleneoxide: not less than 1 and not more than 16) of these alcohol components.

Specific examples of the alcohol component suitably used are the same as the acid components constituting the aforementioned segment (a1). Of these alcohol components, from the viewpoint of improving durability of the resulting toner, preferred are aromatic olio's and alicyclic diols, and more preferred are alkylene (having not less than 2 and not more than 3 carbon atoms) oxide adducts (average molar number of addition of alkyleneoxide: not less than 1 and not more than 16) of bisphenol A such as polyoxypropylene-2,2-bis(4-hydroxyphenyl)propane and polyoxyethylene-2,2-bis(4-hydroxyphenyl)propane. Furthermore, the alcohol component may contain a hydrogenated bisphenol A such as 2,2'-bis(4-hydroxycyclohexyl)propane.

The content of the aromatic diol in the alcohol component is preferably not less than 60 mol %, more preferably not less than 80 mol %, even more preferably not less than 90 mol %, further even more preferably not less than 95 mol % and still further even more preferably 100 mol %.

The polyester resin may be produced, for example, by subjecting the aforementioned alcohol component and the aforementioned carboxylic acid component to polycondensation reaction in an inert gas atmosphere, if required, using an esterification catalyst, a polymerization inhibitor, etc. In this case, the polycondensation reaction conditions, as well as the esterification catalyst, the esterification co-catalyst, the polymerization inhibitor, etc., as described in the production of the aforementioned composite resin can also be suitably used for the production of the polyester resin.

The softening point of the resin constituting the resin particles (B) is preferably not lower than 80° C., more preferably not lower than 85° C. and even more preferably not lower than 88° C., and is also preferably not higher than 110° C., more preferably not higher than 105° C., even more preferably not higher than 100° C. and further even more preferably not higher than 95° C., from the viewpoint of suppressing desorption and exposure of the releasing agent and obtaining a toner that is excellent in solid-image followup ability upon printing.

The glass transition temperature of the resin constituting the resin particles (B) is preferably not lower than 30° C., more preferably not lower than 32° C. and even more preferably not lower than 35° C., and is also preferably not higher than 60° C., more preferably not higher than 55° C. and even more preferably not higher than 50° C., from the viewpoint of suppressing desorption and exposure of the releasing agent and obtaining a toner that is excellent in solid-image followup ability upon printing.

The acid value of the resin constituting the resin particles (B) is preferably not less than 5 mgKOH/g, more preferably not less than 6 mgKOH/g, even more preferably not less than 8 mgKOH/g and further even more preferably not less than 10 mgKOH/g, and is also preferably not more than 35 mgKOH/g, more preferably not more than 32 mgKOH/g and even more preferably not more than 30 mgKOH/g, from the viewpoint of improving dispersion stability of the water dispersion of the resin particles.

The softening point, glass transition temperature and acid value of the resin constituting the resin particles (B) may be respectively adjusted to desired values by suitably controlling the kinds of alcohol component and carboxylic acid component used therein, the ratios of raw materials charged, the temperature used upon the polycondensation and the reaction time.

The total content of the aforementioned acid component and alcohol component in the components from which the constitutional units of the polyester resin segment (b1) are derived is preferably not less than 80% by mass, more preferably not less than 90% by mass, even more preferably not less than 95% by mass, further even more preferably not less than 98% by mass and still further even more preferably 100% by mass.

In addition, the proportion of the acid component to 100 mole parts of the alcohol component is preferably not less than 70 mole parts, more preferably not less than 75 mole parts and even more preferably not less than 80 mole parts, and is also preferably not more than 120 mole parts, more preferably not more than 110 mole parts and even more preferably not more than 105 mole parts.

[Other Components in Resin Particles (B)]

The resin particles (B) may also contain a colorant, a releasing agent and an antistatic agent unless the advantageous effects of the present invention are adversely affected. In addition, the resin particles (B) may also contain other additives such as a reinforcing filler such as fibrous substances, an antioxidant and an anti-aging agent, if required.

Meanwhile, as described hereinlater, it is preferred that the colorant is previously prepared in the form of colorant-containing particles separately from the resin particles (B), and the colorant-containing particles are subsequently aggregated together with the resin particles (B) to obtain aggregated particles.

(Production of Resin Particles (B))

The resin particles (B) are preferably produced by the method in which the resin is dispersed, if required, together with the surfactant and the aforementioned optional components in the aqueous medium to obtain a water dispersion of the resin particles (B).

The aqueous medium used for producing the water dispersion of the resin particles (B) preferably contains water as a main component similarly to the aqueous medium used for producing the water dispersion of the resin particles (A). From the viewpoint of improving dispersion stability of the water dispersion of the resin particles (B) and attaining good environmental suitability, the content of water in the aqueous medium is preferably not less than 80% by mass, more preferably not less than 90% by mass, even more preferably not less than 95% by mass, further even more preferably 98% by mass and still further even more preferably 100% by mass. As the water, deionized water or distilled water is preferably used.

As the method of obtaining the water dispersion of the resin particles (B), the phase inversion emulsification method as used above upon production of the water dispersion of the resin particles (A) is preferably used, and the preferred forms of the neutralizing agent, surfactant, etc., used in the method are also the same as those used upon production of the water dispersion of the resin particles (A).

From the viewpoint of suppressing desorption and exposure of the releasing agent and improving solid-image followup ability, releasing properties and low-temperature fusing properties of the resulting toner, it is preferred that no surfactant is used in the water dispersion of the resin particles (B). However, from the viewpoint of improving dispersion stability of the resin particles in the aqueous medium, a small amount of the surfactant may be used in the water dispersion of the resin particles (B). Examples of the suitable surfactant are the same as described above.

The amount of the surfactant used in the water dispersion of the resin particles (B) is preferably not less than 0% by mass, more preferably not less than 0.5% by mass and even more preferably not less than 1% by mass on the basis of 100 parts by mass of the resin particles (B) from the viewpoint of improving dispersion stability of the resin particles in the aqueous medium, and is also preferably not more than 20% by mass, more preferably not more than 10% by mass and even more preferably not more than 5% by mass on the basis of 100 parts by mass of the resin particles (B) from the viewpoint of suppressing desorption and exposure of the releasing agent and improving solid-image followup ability, releasing properties and low-temperature fusing properties of the resulting toner.

The solid content of the water dispersion of the resin particles (B) is preferably not less than 10% by mass, more preferably not less than 15% by mass and even more preferably not less than 20% by mass, and is also preferably not more than 50% by mass, more preferably not more than 40% by mass and even more preferably not more than 35% by mass, from the viewpoint of improving dispersion stability of the water dispersion of the resin particles, facilitating handling of the water dispersion of the resin particles, and enhancing productivity of the toner. Meanwhile, the solid content as used herein means the value based on non-volatile components including the resins, pigments, surfactants and the like.

The volume median particle size ($D_{50}$) of the resin particles (B) contained in the water dispersion of the resin particles (B) is preferably not less than 0.02 μm, more preferably not less than 0.05 μm and even more preferably not less than 0.08 μm, and is also preferably not more than 1.00 μm, more preferably not more than 0.50 μm and even more preferably not more than 0.30 μm, from the viewpoint of obtaining a toner capable of producing high quality images.

(Colorant)

In the step (2), a colorant may be further added upon obtaining the aggregated particles (1). In this case, the colorant may be dispersed in an aqueous medium to prepare a colorant dispersion, and the thus prepared colorant dispersion may be added in the step (2) to obtain the aggregated particles.

The colorant used in the present invention may be either a pigment or a dye. From the viewpoint of enhancing image density of the resulting toner, of these colorants, the pigment is preferably used.

Specific examples of the pigment include carbon blacks, inorganic composite oxides, benzidine yellow, brilliant carmine 3B, brilliant carmine 6B, red iron oxide, aniline blue, ultramarine blue, copper phthalocyanine and phthalocyanine green. Among these pigments, preferred is copper phthalocyanine.

Specific examples of the dye include acridine dyes, azo dyes, benzoquinone dyes, azine dyes, anthraquinone dyes, indigo dyes, phthalocyanine dyes and Aniline Black dyes.

These colorants may be used alone or in combination of any two or more thereof.

The colorant dispersion may be suitably produced by mixing the colorant and, if required, a surfactant, with the aqueous medium. In this case, the colorant is preferably dispersed in the aqueous medium using a homogenizer, etc.

The procedure of dispersing the colorant in the aqueous medium is preferably conducted in the presence of the surfactant from the viewpoint of improving dispersion stability of the colorant.

Examples of the surfactant used for production of the colorant include those surfactants as described in the production of the aforementioned water dispersion of the resin particles (A). Of these surfactants, preferred is the anionic surfactant. Specific examples of the anionic surfactant include sodium dodecylbenzenesulfonate, sodium dodecylsulfate, sodium laurylethersulfate and dipotassium alkenyl succinates. Of these anionic surfactants, preferred is sodium dodecylbenzenesulfonate.

Examples of the preferred aqueous medium include those aqueous media as described in the production of the aforementioned water dispersion of the resin particles (A).

The contents of the solid components and the colorant in the colorant dispersion are each preferably not less than 10% by mass, more preferably not less than 15% by mass and even more preferably not less than 20% by mass, and is also preferably not more than 40% by mass, more preferably not more than 35% by mass and even more preferably not more than 30% by mass.

The amount of the surfactant used on the basis of 100 parts by mass of the colorant is preferably not less than 10 parts by mass, more preferably not less than 15 parts by mass and even more preferably not less than 20 parts by mass, and is also preferably not more than 40 parts by mass, more preferably not more than 35 parts by mass and even more preferably not more than 30 parts by mass, from the viewpoint of improving dispersion stability of the colorant particles and suppressing desorption and exposure of the releasing agent.

The volume median particle size ($D_{50}$) of the colorant particles in the colorant dispersion is preferably not less than 0.05 μm, more preferably not less than 0.08 μm and even more preferably not less than 0.10 μm, and is also preferably not more than 0.30 μm, more preferably not more than 0.20 μm and even more preferably not more than 0.15 μm.

(Step (2A))

In the step (2A), the water dispersion of the releasing agent particles, the water dispersion of the resin particles (B1) and, if required, an aggregating agent are mixed and aggregated with each other to aggregate the releasing agent particles and the resin particles (B1), thereby obtaining the aggregated particles (1). In this case, it is preferred that the water dispersion of the releasing agent particles and the water dispersion of the resin particles (B1) as well as, if required, the aggregating agent, the colorant and the aqueous medium, are added and mixed with each other to obtain a water dispersion of the aggregated particles (1).

First, the resin particles (B1) and the releasing agent particles are mixed in the aqueous medium to obtain a mixed dispersion.

Meanwhile, in the case where no colorant is mixed in the resin particles (B1), the colorant is preferably mixed in the aforementioned mixed dispersion. In this case, the colorant to be mixed is preferably in the form of the aforementioned colorant dispersion. The colorant may be added in one or both of the step (2A) and the step (2B). It is, however, preferred that the colorant is added in the step (2A), and no colorant is added in the step (2B), so that it becomes possible to suppress desorption of the colorant from the resulting toner.

In addition, the mixed dispersion may also contain resin particles other than the resin particles (B1) unless the advantageous effects of the present invention are adversely affected.

The order of mixing of the respective components is not particularly limited, and these components may be added either sequentially or simultaneously.

The content of the resin particles (B1) in the mixed dispersion containing the resin particles (B1) and the releasing agent particles is preferably not less than 10 parts by mass and more preferably not less than 15 parts by mass, and is also preferably not more than 40 parts by mass and more preferably not more than 30 parts by mass, on the basis of 100 parts by mass of the mixed dispersion, from the viewpoint of suppressing desorption and exposure of the releasing agent and obtaining a toner that is excellent in solid-image followup ability upon printing.

In addition, the content of the colorant in the mixed dispersion is preferably not less than 2 parts by mass and more preferably not less than 3 parts by mass, and is also preferably not more than 20 parts by mass and more preferably not more than 10 parts by mass, on the basis of 100 parts by mass of the resin particles (B1), from the viewpoint of enhancing image density of the resulting toner.

The content of the releasing agent particles in the mixed dispersion is preferably not less than 2 parts by mass and more preferably not less than 5 parts by mass, and is also preferably not more than 20 parts by mass and more preferably not more than 15 parts by mass, on the basis of 100 parts by mass of the resin particles (B1), from the viewpoint of improving releasing properties of the resulting toner, suppressing desorption and exposure of the releasing agent and obtaining a toner that is excellent in solid-image followup ability upon printing.

The mixing temperature used upon production of the aforementioned mixed dispersion is preferably not lower than 0° C. and not higher than 40° C., from the viewpoint of well controlling aggregation of the particles to obtain aggregated particles having a particle size as desired.

Next, the particles in the mixed dispersion are aggregated together, so that it is possible to suitably obtain a water dispersion of the aggregated particles (1). In this case, an aggregating agent is preferably added to the mixed dispersion in order to efficiently conduct aggregation of the particles.

Specific examples of the aggregating agent used above include organic aggregating agents such as a cationic surfactant in the form of a quaternary salt and polyethyleneimine; and inorganic aggregating agents such as an inorganic metal salt, an inorganic ammonium salt and a divalent or higher-valent metal complex.

Specific examples of the inorganic metal salt include metal salts such as sodium sulfate, sodium chloride, calcium chloride, magnesium sulfate, calcium nitrate, magnesium chloride, zinc chloride, aluminum chloride and aluminum sulfate; and inorganic metal salt polymers such as poly (aluminum chloride) and poly(aluminum hydroxide). Specific examples of the inorganic ammonium salt include ammonium sulfate, ammonium chloride and ammonium nitrate.

The aggregating agent used in the present invention is preferably in the form of an electrolyte and more preferably a salt, from the viewpoint of obtaining a toner having a particle size as desired while preventing excessive aggregation thereof. The valence of the aggregating agent is preferably from mono- to penta-valence, more preferably from mono- to di-valence, and even more preferably monovalence. That is, it is further preferable to use a monovalent salt as the aggregating agent. The monovalent salt as used herein means that the valence of a metal ion or a cation constituting the salt is (monovalence). Examples of the monovalent salt include the aforementioned inorganic metal salts and inorganic ammonium salts. Among these monovalent salts, the inorganic ammonium salts are preferably used.

Of these aggregating agents, from the viewpoint of improving aggregating properties of the particles to obtain uniform aggregated particles, preferred are the inorganic ammonium salts, and more preferred is ammonium sulfate.

The amount of the aggregating agent used is preferably not less than 1 part by mass, more preferably not less than 10 parts by mass and even more preferably not less than 20 parts by mass on the basis of 100 parts by mass of the resin constituting the resin particles (B), from the viewpoint of well controlling aggregation of the resin particles to obtain aggregated particles having a particle size as desired. The amount of the aggregating agent used is also preferably not more than 50 part by mass, more preferably not more than 40 part by mass and even more preferably not more than 35 part by mass on the basis of 100 parts by mass of the respective resins constituting the resin particles (A) and the resin particles (B1) from the viewpoint of improving durability of the resulting toner.

As the aggregating method, there may be mentioned a method in which the aggregating agent, preferably a solution of the aggregating agent in an aqueous medium, is added dropwise into a reaction vessel filled with the mixed dispersion. The aggregating agent to be added dropwise is preferably in the form of an aqueous solution thereof, from the viewpoint of well controlling aggregation of the resin particles to obtain aggregated particles having a particle size as desired. The concentration of the aqueous solution of the aggregating agent is preferably not less than 3% by mass, more preferably not less than 5% by mass and even more preferably not less than 7% by mass, and is also preferably not more than 30% by mass, more preferably not more than 20% by mass and even more preferably not more than 15% by mass, from the viewpoint of well controlling aggregation of the resin particles to obtain aggregated particles having a desired particle size. In this case, the aggregating agent may be added at one time, or continuously or intermittently. Furthermore, the aggregating agent may be split-added, i.e., added plural times in a split addition manner. Upon and after adding the aggregating agent, the obtained dispersion is preferably fully stirred.

From the viewpoint of well controlling aggregation of the particles to obtain aggregated particles having a particle size as desired and enhancing productivity of the toner, the dropwise addition time of the aggregating agent is preferably not less than 1 minute and not more than 120 minutes. The temperature used upon the dropwise addition of the aggregating agent is preferably not lower than 0° C. and not higher than 50° C., from the viewpoint of well controlling aggregation of the particles to obtain aggregated particles having a particle size as desired.

Furthermore, from the viewpoint of promoting aggregation of the particles and well controlling a particle size of the resulting aggregated particles to suppress formation of coarse particles, the temperature of the dispersion obtained after adding the aggregating agent to the mixed dispersion is preferably raised and maintained. The temperature of the dispersion to be maintained is preferably not lower than 50° C. and not higher than 70° C. It is preferred that the progress of the aggregation of the particles is confirmed by monitoring a volume median particle size (DO of the resulting aggregated particles. The volume median particle size ($D_{50}$) may be measured by the method described in Examples below.

From the viewpoint of obtaining a toner capable of producing high quality images, the volume median particle size ($D_{50}$) of the resulting aggregated particles (1) is preferably not more than 15 μm, more preferably not more than 10 μm and even more preferably not more than 8 μm, and is also preferably not less than 1 μm, more preferably not less than 2 μm and even more preferably not less than 3 μm. The volume median particle size ($D_{50}$) of the aggregated particles (1) may be concretely measured by the method described in Examples below.

The amount of a fine powder in the aggregated particles (1) is preferably not more than 10% by mass, more preferably not more than 8% by mass and even more preferably not more than 5% by mass from the viewpoint of obtaining a toner capable of producing high quality images.

The "fine powder" as used herein means a particle (fine particle) having a size of not more than 2 μm, and the "amount of a fine powder in the aggregated particles (1)" as used herein means a content of the fine powder in the aggregated particles (1). The method of measuring the amount of the fine powder is described in Examples below.

(Step (2B))

In the step (2B), the resin particles (B2) are added to the aggregated particles (1) obtained in the step (2A) at one time or plural times in a split addition manner to obtain aggregated particles (2) formed by adhering the resin particles (B2) onto the aggregated particles (1) (resin particle (B)-adhered aggregated particles). In this case, the resin particles (B) are preferably added to the water dispersion of the aggregated particles (1) as described in the step (2A) at one time or plural times in a split addition manner to obtain aggregated particles (2) formed by adhering the resin particles (B2) onto the aggregated particles (1) (resin particle (B)-adhered aggregated particles).

By conducting the step (2B), it is possible to effectively prevent desorption of the releasing agent, etc., from the resulting toner particles.

In the case where the resin particles (B2) are added plural times in a split addition manner to the dispersion, the amounts of the respective split parts of the resin particles (B2) to be split-added are preferably identical to each other. In addition, the resin particles (B2) may be added to the dispersion either plural times in a split addition manner or at one time without being split. Also, in the case where the resin particles (B2) are added plural times in a split addition manner to the dispersion, the number of times of split addition of the resin particles (B2) is not particularly limited, and is preferably not less than 2 from the viewpoint of well controlling a particle size of the aggregated particles (2) formed, and is also preferably not more than 10 and more preferably not more than 8 from the viewpoint of enhancing productivity of the aggregated particles (2).

The resin particles (B2) used in the step (2B) may be the same as the resin particles (B1) used in the step (2A), or may be different in composition therefrom.

The softening point, glass transition temperature and acid value of the resin constituting the resin particles (B2) suitably used in the step (2B) are the same as those of the resin constituting the resin particles (B1) used in the step (2A).

The compounding mass ratio of the aggregated particles (1) in the water dispersion of the aggregated particles (2) to the resin particles (B2) added in the step (2B) (aggregated particles (1)/resin particles (B2)) is preferably not less than 0.1, more preferably not less than 0.5 and even more preferably not less than 1.0, and is also preferably not more than 5.0, more preferably not more than 4.0 and even more preferably not more than 3.0, from the viewpoint of suppressing desorption and exposure of the releasing agent and obtaining a toner that is excellent in solid-image followup ability upon printing.

The time of addition of the resin particles (B2) in the step (2B) is not particularly limited as long as the resin particles (B2) can be adhered onto the aggregated particles (1). From the viewpoint of well controlling a particle size of the resulting aggregated particles (2), the resin particles (B2) are preferably added at the time between after completion of the first addition of the aggregating agent and before initiation of the coalescing step.

In the case where the dispersion of the resin particles (B2) is added to the dispersion of the aggregated particles (1), the aggregating agent may be added in the step (2B) in order to allow the resin particles (B2) to efficiently adhere onto the aggregated particles (1).

The temperature in the reaction system of the step (2B) is preferably not lower than 50° C. and not higher than 70° C. from the viewpoint of well controlling a particle size of the resulting aggregated particles (2).

The volume median particle size ($D_{50}$) of the aggregated particles (2) is preferably not less than 2 μm, more preferably not less than 3 μm and even more preferably not less than 4 μm, and is also preferably not more than 10 μm, more preferably not more than 9 μm and even more preferably not more than 8 μm, from the viewpoint of obtaining a toner capable of producing high quality images.

Also, the amount of a fine powder in the aggregated particles (2) is preferably not more than 10% by mass, more preferably not more than 8% by mass and even more preferably not more than 5% by mass from the viewpoint of obtaining a toner capable of producing high quality images.

The "fine powder" as used herein means a particle (fine particle) having a size of not more than 2 μm, and the "amount of a fine powder in the aggregated particles (2)" as used herein means a content of the fine powder in the aggregated particles (2). The method of measuring the amount of the fine powder is described in Examples below.

At the time at which growth of the particles having such a particle size that is appropriate as that of the toner is achieved by adding the resin particles (B2), the aggregating step is stopped.

As the method of stopping the aggregating step, there may be used a method of cooling the dispersion, a method of adding an aggregation stopping agent to the dispersion, etc. Of these methods, from the viewpoint of surely preventing occurrence of unnecessary aggregation of the particles, preferred is the method of adding an aggregation stopping agent to the dispersion to stop the aggregating step.

As the aggregation stopping agent, a surfactant is preferably used. The aggregation stopping agent used is more preferably an anionic surfactant. Examples of the anionic surfactant include alkylethersulfuric acid salts, alkylsulfuric acid salts, linear alkyl benzenesulfonic acid salts and polyoxyethylene alkylethersulfuric acid salts. Of these aggregation stopping agents, preferred are polyoxyethylene alkylethersulfuric acid salts, and more preferred is sodium polyoxyethylene laurylethersulfate.

These aggregation stopping agents may be used alone or in combination of any two or more thereof.

The amount of the aggregation stopping agent added is preferably not less than 0.1 part by mass, more preferably not less than 1 part by mass and even more preferably not less than 2 parts by mass, on the basis of 100 parts by mass of the resin constituting the aggregated particles (1) or the resin constituting the aggregated particles (2) (i.e., a total amount of the resin constituting the aggregated particles (1) and the resin constituting the resin particles (B)), from the viewpoint of stopping aggregation of the particles, and is also preferably not more than 10 parts by mass and more preferably not more than 5 parts by mass, on the basis of 100 parts by mass of the resin constituting the aggregated particles (1) or the resin constituting the aggregated particles (2), from the viewpoint of reducing an amount of the aggregation stopping agent remaining in the resulting toner. The aggregation stopping agent may be used in any configuration as long as the amount of the aggregation stopping agent added lies within the above-specified range. However, the aggregation stopping agent is preferably added in the form of an aqueous solution thereof, from the viewpoint of enhancing productivity of the toner.

The temperature upon adding the aggregation stopping agent to the dispersion is preferably the same as the temperature at which the dispersion of the aggregated particles is to be maintained, more specifically, not lower than 50° C. and not higher than 70° C., from the viewpoint of enhancing productivity of the toner.

<Step (3)>

In the step (3), the aggregated particles obtained in the step (2) are coalesced together to obtain coalesced particles.

The "aggregated particles obtained in the step (2)" as used herein mean the aggregated particles (1) obtained in the step (2A) in the case where the step (2B) is not carried out, and also mean the aggregated particles (2) obtained in the step (2B) in the case where the step (2B) is carried out. It is estimated that the resin particles or releasing agent particles contained in the aggregated particles obtained in the step (2) which are adhered to each other mainly by a physical force only are integrally coalesced together during the coalescing step to thereby form the coalesced particles.

From the viewpoint of improving coalescing properties of the aggregated particles and enhancing productivity of the toner, the heating temperature used upon the coalescing step is preferably not lower than a glass transition temperature of the resin constituting the aggregated particles (2) and not higher than 100° C., more preferably not lower than the glass transition temperature of the resin constituting the aggregated particles (2) and not higher than 90° C., and even more preferably not lower than the glass transition temperature of the resin constituting the aggregated particles (2) and not higher than 85° C.

From the viewpoint of producing high quality images, the volume median particle size ($D_{50}$) of the coalesced particles obtained in the step (3) is preferably not less than 2 μm, more preferably not less than 3 μm and even more preferably not less than 4 μm, and is also preferably not more than 20 μm, more preferably not more than 15 μm, even more preferably not more than 10 μm and further even more preferably not more than 8 μm.

In addition, the circularity of the coalesced particles is preferably not less than 0.900, more preferably not less than 0.950 and even more preferably not less than 0.970, and is also preferably not more than 0.990, more preferably not more than 0.985 and even more preferably not more than 0.980, from the viewpoint of reducing occurrence of toner cloud and obtaining high quality images. The volume median particle size ($D_{50}$) and circularity of the coalesced particles may be concretely measured by the methods described in Examples below.

[Additional Treatment Step]

In the present invention, after completion of the step (3), the obtained dispersion may be subjected to an additional treatment step. In the additional treatment step, the coalesced particles are preferably isolated from the dispersion to thereby obtain toner particles.

The coalesced particles obtained in the step (3) are present in the aqueous medium. Therefore, the dispersion containing the coalesced particles is preferably first subjected to solid-liquid separation. The solid-liquid separation procedure is preferably conducted by a suction filtration method, etc.

The particles obtained by the solid-liquid separation are then preferably subjected to rinsing treatment. In this case, when using the nonionic surfactant upon producing the resin particles (A) and (B), it is preferred that the nonionic surfactant thus added is also removed by the rinsing treatment. Therefore, the resulting particles are preferably rinsed with an aqueous medium at a temperature not higher than a cloud point of the nonionic surfactant. The rinsing treatment is preferably carried out plural times.

Next, the thus treated coalesced particles are preferably dried. The temperature upon drying the coalesced particles is preferably controlled such that the temperature of the coalesced particles themselves is preferably lower by not less than 5° C. than a glass transition temperature of the resin constituting the coalesced particles, and more preferably lower by not less than 10° C. than the glass transition temperature.

As the drying method, there are preferably adopted optional methods such as a vacuum low-temperature drying method, a vibration-type fluidization drying method, a spray-drying method, a freeze-drying method and a flash jet method, etc. The content of water in the toner particles obtained after drying is preferably adjusted to not more than 1.5% by mass and more preferably not more than 1.0% by mass, from the viewpoint of improving charging properties of the resulting toner.

The volume median particle size ($D_{50}$) of the toner particles or the below-mentioned toner is preferably not less than 2 μm, more preferably not less than 3 μm and even more preferably not less than 4 μm, and is also preferably not more than 20 μm, more preferably not more than 15 μm, even more preferably not more than 10 μm and further even more preferably not more than 8 μm, from the viewpoint of obtaining high quality images.

The volume median particle size ($D_{50}$) of the toner particles may be determined by the method described in Examples below.

The circularity of the toner particles or the toner is preferably not less than 0.900, more preferably not less than 0.950 and even more preferably not less than 0.970, and is also preferably not more than 0.990, more preferably not more than 0.985 and even more preferably not more than 0.980, from the viewpoint of reducing occurrence of toner cloud and obtaining high quality images.

The amount of a fine powder in the toner particles or the toner is preferably not more than 10% by mass, more preferably not more than 8% by mass and even more preferably not more than 5% by mass from the viewpoint of obtaining a toner capable of producing high quality images.

The "fine powder" as used herein means a particle (fine particle) having a size of not more than 2 μm, and the "amount of a fine powder in the toner particles or the toner" as used herein means a content of the fine powder in the toner particles or the toner. The method of measuring the amount of the fine powder is described in Examples below.

The amount of change between the amount of the fine powder in the aggregated particles obtained in the step (2) and the amount of the fine powder in the toner particles or the toner is preferably not more than 10% by mass, more preferably not more than 5% by mass, even more preferably not more than 3% by mass and further even more preferably not more than 1% by mass from the same viewpoint as described above.

Also, the amount of change between the amount of the fine powder in the aggregated particles (2) and the amount of the fine powder in the toner particles or the toner is preferably not more than 10% by mass, more preferably not more than 5% by mass, even more preferably not more than 3% by mass and further even more preferably not more than 1% by mass from the same viewpoint as described above. The increase in the amounts of these fine powders is mainly caused by desorption of the releasing agent particles in the coalescing step. As the amount of change between the amounts of the fine powders is reduced, the desorption of the releasing agent in the coalescing step is more effectively inhibited.

The amount of change between the amounts of the fine powders may be measured by the method described in Examples below.

[Process for Producing Water Dispersion of Releasing Agent Particles]

The process for producing a water dispersion of releasing agent particles according to the present invention includes the following step (1):

step (1): mixing a releasing agent and a water dispersion of resin particles (A) to obtain the water dispersion of the releasing agent particles, in which the resin particles (A) include a composite resin including a segment (a1) constituted of a polyester resin and a vinyl-based resin segment (a2) containing a constitutional unit derived from a styrene-based compound in an amount of not less than 90% by mass.

The step (1) of the aforementioned production process is the same as previously described herein.

[Toner for Development of Electrostatic Images]

The toner particles obtained by the drying, etc., may be directly used as the toner according to the present invention. However, it is preferred that the toner particles are subjected to the below-mentioned surface treatment, and the thus surface-treated toner particles are used as the toner for development of electrostatic images.

The toner particles as the toner for development of electrostatic images thus produced according to the production process of the present invention may be directly used as a toner. However, it is preferred that the toner particles are preferably subjected to surface treatment in which an aid such as a fluidizing agent is applied as an external additive onto the surface of the respective toner particles, and the resulting surface-treated toner particles are used as the toner. Examples of the external additive include inorganic fine particles such as surface-hydrophobized silica fine particles, titanium oxide fine particles, alumina fine particles, cerium oxide fine particles and carbon blacks; and polymer fine particles such as fine particles of polycarbonates, polymethyl methacrylate, silicone resins, etc. Of these fine particles, preferred are hydrophobic silica fine particles.

The amount of the external additive added to the toner is preferably not less than 1 part by mass, more preferably not less than 2 parts by mass and even more preferably not less than 3 parts by mass, and is also preferably not more than 5 parts by mass and more preferably not more than 4.7 parts by mass, on the basis of 100 parts by mass of the toner particles before being treated with the external additive.

The toner for development of electrostatic images which is obtained according to the present invention can be used as a one-component system developer, or can be mixed with a carrier to form a two-component system developer.

With respect to the aforementioned embodiments, the present invention further provides the following aspects relating to the process for producing a toner for development of electrostatic images.

<1> A process for producing a toner for development of electrostatic images, including the following steps (1) to (3):

step (1): mixing a releasing agent and a water dispersion of resin particles (A) to obtain a water dispersion of releasing agent particles;

step (2): mixing the water dispersion of the releasing agent particles obtained in the step (1) and a water dispersion of resin particles (B) to aggregate the releasing agent particles and the resin particles (B), thereby obtaining aggregated particles; and step (3): coalescing the aggregated particles obtained in the step (2) to obtain coalesced particles, in which the resin particles (A) include a composite resin including a segment (a1) constituted of a polyester resin and a vinyl-based resin segment (a2) containing a constitutional unit derived from a styrene-based compound; and a resin constituting the resin particles (B) includes a segment (b1) constituted of a polyester resin in an amount of not less than 50% by mass.

<2> The process for producing a toner for development of electrostatic images according to the above aspect <1>, wherein the resin particles (A) include the composite resin in an amount of not less than 90% by mass.

<3> The process for producing a toner for development of electrostatic images according to the above aspect <1> or <2>, wherein a content of the composite resin in the resin particles (A) is preferably not less than 90% by mass, more preferably not less than 95% by mass, even more preferably not less than 98% by mass, further even more preferably not less than 99% by mass and still further even more preferably 100% by mass, and is also not more than 100% by mass.

<4> The process for producing a toner for development of electrostatic images according to any one of the above aspects <1> to <3>, wherein a content of a surfactant in the water dispersion of the releasing agent particles is preferably not more than 1 part by mass, more preferably not more than 0.5 part by mass and even more preferably not more than 0.1 part by mass on the basis of 100 parts by mass of the releasing agent.

<5> The process for producing a toner for development of electrostatic images according to any one of the above aspects <1> to <4>, wherein the releasing agent contains at least one wax selected from the group consisting of a paraffin wax and an ester wax, and preferably a paraffin wax, in an amount of not less than 95% by mass.

<6> The process for producing a toner for development of electrostatic images according to any one of the above aspects <1> to <5>, wherein the vinyl-based resin segment (a2) contains a constitutional unit derived from a bireactive monomer.

<7> The process for producing a toner for development of electrostatic images according to the above aspect <6>, wherein the bireactive monomer is a vinyl monomer containing at least one functional group selected from the group consisting of a hydroxy group, a carboxy group, an epoxy group, a primary amino group and a secondary amino group in a molecule thereof, preferably a vinyl monomer containing a hydroxy group and/or a carboxy group and more preferably a vinyl monomer containing a carboxy group, and the vinyl monomer containing a carboxy group is preferably at least one monomer selected from the group consisting of acrylic acid, methacrylic acid, fumaric acid and maleic acid, more preferably at least one monomer selected from the group consisting of acrylic acid and methacrylic acid, and even more preferably acrylic acid.

<8> The process for producing a toner for development of electrostatic images according to the above aspect <6> or <7>, wherein an amount of the bireactive monomer used is not less than 1 mole part, more preferably not less than 3 mole parts, even more preferably not less than 5 mole parts and further even more preferably not less than 8 mole parts, and is also preferably not more than 30 mole parts, more preferably not more than 25 mole parts and even more preferably not more than 20 mole parts, on the basis of 100 mole parts of a total amount of the alcohol component as a raw material of the polyester resin segment (a1).

<9> The process for producing a toner for development of electrostatic images according to any one of the above aspects <6> to <8>, wherein a total content of the styrene-based compound, the other vinyl monomer and the bireactive monomer in the components from which the constitutional units of the vinyl-based resin segment (a2) are derived, is preferably not less than 80% by mass, more preferably not less than 90% by mass, even more preferably not less than 95% by mass and further even more preferably 100% by mass.

<10> The process for producing a toner for development of electrostatic images according to any one of the above aspects <1> to <9>, wherein a volume average particle size ($D_v$) of the resin particles (A) is not less than 0.02 μm and not more than 0.50 μm.

<11> The process for producing a toner for development of electrostatic images according to any one of the above aspects <1> to <10>, wherein a mass ratio of the releasing agent to the resin particles (A) [releasing agent/resin particles (A)] is preferably from 100/1 to 100/100, more preferably from 100/10 to 100/60, even more preferably from 100/20 to 100/50 and further even more preferably from 100/25 to 100/45.

<12> The process for producing a toner for development of electrostatic images according to any one of the above aspects <1> to <11>, wherein the water dispersion of the resin particles (A) contains water in an amount of not less than 90% by mass, preferably not less than 95% by mass, more preferably not less than 98% by mass and even more preferably 100% by mass on the basis of a dispersing medium thereof.

<13> The process for producing a toner for development of electrostatic images according to any one of the above aspects <1> to <12>, wherein the water dispersion of the resin particles (B) contains water in an amount of not less than 90% by mass on the basis of a dispersing medium thereof.

<14> The process for producing a toner for development of electrostatic images according to any one of the above aspects <1> to <13>, wherein a volume median particle size ($D_{50}$) of the releasing agent particles is preferably not less than 0.05 μm, more preferably not less than 0.20 μm, even more preferably not less than 0.40 μm and further even more preferably not less than 0.45 μm, and is also preferably not more than 1.00 μm, more preferably not more than 0.80 μm, even more preferably not more than 0.70 μm, further even more preferably not more than 0.65 μm and still further even more preferably not more than 0.60 μm.

<15> The process for producing a toner for development of electrostatic images according to any one of the above aspects <1> to <14>, wherein a melting point of the releasing agent is preferably not lower than 60° C., more preferably not lower than 65° C. and even more preferably not lower than 70° C., and is also preferably not higher than 100° C., more preferably not higher than 95° C., even more preferably not higher than 90° C. and further even more preferably not higher than 85° C.

<16> The process for producing a toner for development of electrostatic images according to any one of the above aspects <1> to <15>, wherein an amount of the releasing agent used is preferably not less than 1 part by mass, more preferably not less than 2 parts by mass and even more preferably not less than 3 parts by mass, and is also preferably not more than 10 parts by mass and more preferably not more than 5 parts by mass on the basis of 100 parts by mass of the resins in the toner.

<17> The process for producing a toner for development of electrostatic images according to any one of the above aspects <1> to <16>, wherein an acid component constituting the segment (a1) preferably contains an aliphatic carboxylic acid, more preferably at least an aliphatic dicarboxylic acid, and even more preferably an aliphatic dicarboxylic acid and an aromatic dicarboxylic acid.

<18> The process for producing a toner for development of electrostatic images according to any one of the above aspects <1> to <18>, wherein the aliphatic dicarboxylic acid constituting the segment (a1) is sebacic acid, fumaric acid, maleic acid, adipic acid, succinic acid, cyclohexanedicarboxylic acid, or a substituted succinic acid containing an alkyl group having not less than 1 and not more than 20 carbon atoms or an alkenyl group having not less than 2 and not more than 20 carbon atoms as a substituent group, preferably at least one acid selected from the group consisting of fumaric acid, sebacic acid, succinic acid, a substituted succinic acid containing an alkenyl group having not less than 2 and not more than 20 carbon atoms as a substituent group, and an anhydride of these acids, more preferably at least one acid selected from the group consisting of fumaric acid, sebacic acid and succinic acid, and even more preferably at least one acid selected from the group consisting of fumaric acid and succinic acid.

<19> The process for producing a toner for development of electrostatic images according to any one of the above aspects <1> to <18>, wherein the aromatic dicarboxylic acid constituting the segment (a1) is at least one acid selected from the group consisting of phthalic acid, isophthalic acid and terephthalic acid, preferably contain the aromatic dicarboxylic acid, and more preferably is terephthalic acid.

<20> The process for producing a toner for development of electrostatic images according to any one of the above aspects <1> to <19>, wherein a content of the aliphatic carboxylic acid component in the acid component constituting the polyester resin segment (a1) is preferably not less than 10% by mass and more preferably not less than 15% by mass, and is also preferably not more than 80% by mass and more preferably not more than 70% by mass.

<21> The process for producing a toner for development of electrostatic images according to any one of the above aspects <1> to <20>, wherein a content of the aromatic dicarboxylic acid in the acid component constituting the polyester resin segment (a1) is preferably not less than 10% by mass, more preferably not less than 15% by mass and even more preferably not less than 20% by mass, and is also preferably not more than 90% by mass, more preferably not more than 85% by mass and even more preferably not more than 80% by mass.

<22> The process for producing a toner for development of electrostatic images according to any one of the above aspects <1> to <21>, wherein the alcohol component constituting the segment (a1) is at least one alcohol selected from the group consisting of aromatic diols, aliphatic diols having not less than 2 and not more than 12 main-chain carbon atoms, alicyclic diols, trivalent or higher-valent polyhydric alcohols, and alkylene (having not less than 2 and not more than 4 carbon atoms) oxide adducts (average molar number of addition of alkyleneoxide: not less than 1 and not more than 16) of these alcohol components.

<23> The process for producing a toner for development of electrostatic images according to any one of the above aspects <1> to <22>, wherein the alcohol component constituting the segment (a1) preferably contains an aromatic diol, and more preferably is an alkylene (having not less than 2 and not more than 3 carbon atoms) oxide adduct (average molar number of addition of alkyleneoxide; not less than 1 and not more than 16) of bisphenol A such as polyoxypropylene-2,2-bis(4-hydroxyphenyl)propane and polyoxyethylene-2,2-bis(4-hydroxyphenyl)propane.

<24> The process for producing a toner for development of electrostatic images according to any one of the above aspects <1> to <23>, wherein a content of the aromatic diol in the alcohol component constituting the segment (a1) is preferably not less than 70 mol %, more preferably not less than 80 mol %, even more preferably not less than 90 mol %, further even more preferably not less than 95 mol % and still further even more preferably 100 mol %.

<25> The process for producing a toner for development of electrostatic images according to any one of the above aspects <1> to <24>, wherein a total content of the acid component and the alcohol component in the components constituting the polyester resin segment (a1) is preferably not less than 80% by mass, more preferably not less than 90% by mass, even more preferably not less than 95% by mass, further even more preferably not less than 98% by mass and still further even more preferably 100% by mass; and a proportion of the acid component to 100 mole parts of the alcohol component is preferably not less than 70 mole parts, more preferably not less than 75 mole parts and even more preferably not less than 80 mole parts, and is also preferably not more than 110 mole parts, more preferably not more than 105 mole parts and even more preferably not more than 100 mole parts.

<26> The process for producing a toner for development of electrostatic images according to any one of the above aspects <1> to <25>, wherein the vinyl-based resin segment (a2) contains a constitutional unit derived from a styrene-based compound.

<27> The process for producing a toner for development of electrostatic images according to any one of the above aspects <1> to <26>, wherein the vinyl-based resin segment (a2) contains a constitutional unit derived from a styrene-based compound; the styrene-based compound is preferably a substituted or unsubstituted styrene; a substituent group of the substituted styrene is preferably an alkyl group having not less than 1 and not more than 5 carbon atoms, a halogen atom, an alkoxy group having not less than 1 and not more than 5 carbon atoms, or a sulfonic group or a salt thereof, the styrene-based compound is preferably selected from styrenes such as styrene, methyl styrene, α-methyl styrene, β-methyl styrene, tert-butyl styrene, chlorostyrene, chloromethyl styrene, methoxystyrene, or styrenesulfonic acid or a salt thereof, more preferably contains styrene, and even more preferably is styrene.

<28> The process for producing a toner for development of electrostatic images according to any one of the above aspects <1> to <27>, wherein a content of the styrene-based compound in the vinyl monomer as the raw material from which the constitutional unit of the vinyl-based resin segment (a2) is derived is preferably not less than 50% by mass, more preferably not less than 60% by mass and even more preferably not less than 70% by mass, and is also preferably not more than 95% by mass, more preferably not more than 90% by mass and even more preferably not more than 85% by mass.

<29> The process for producing a toner for development of electrostatic images according to any one of the above aspects <1> to <28>, wherein the vinyl-based resin segment (a2) contains a constitutional unit derived from a vinyl monomer other than the styrene-based compound; the vinyl monomer other than the styrene-based compound is preferably a (meth)acrylic acid ester and more preferably an alkyl ($C_1$ to $C_{24}$) (meth)acrylate; and the number of carbon atoms of an alkyl group in the alkyl (meth)acrylate is preferably not less than 1, more preferably not less than 6, even more preferably not less than 8 and further even more preferably not less than 10, and is also preferably not more than 24, more preferably not more than 22 and even more preferably not more than 20.

<30> The process for producing a toner for development of electrostatic images according to any one of the above aspects <1> to <29>, wherein the vinyl-based resin segment (a2) contains a constitutional unit derived from a vinyl monomer other than the styrene-based compound; the vinyl monomer other than the styrene-based compound is preferably at least one compound selected from the group consisting of methyl (meth)acrylate, ethyl (meth)acrylate, (iso) propyl (meth)acrylate, (iso- or tertiary-)butyl (meth) acrylate, (iso)amyl (meth)acrylate, cyclohexyl (meth) acrylate, 2-ethylhexyl (meth)acrylate, (iso)octyl (meth) acrylate, (iso)decyl (meth)acrylate, (iso)dodecyl (meth) acrylate, (iso)palmityl (meth)acrylate, (iso)stearyl (meth) acrylate and (iso)behenyl (meth)acrylate, more preferably at least one compound selected from the group consisting of 2-ethylhexyl acrylate and stearyl methacrylate, and even more preferably 2-ethylhexyl acrylate or stearyl methacrylate.

<31> The process for producing a toner for development of electrostatic images according to any one of the above aspects <1> to <30>, wherein a content of the vinyl monomer other than the styrene-based compound in the vinyl monomer as the raw material from which the constitutional unit of the vinyl-based resin segment (a2) is derived is preferably not less than 5% by mass, more preferably not less than 10% by mass and even more preferably not less than 15% by mass, and is also preferably not more than 50% by mass, more preferably not more than 40% by mass and even more preferably not more than 30% by mass.

<32> The process for producing a toner for development of electrostatic images according to any one of the above aspects <1> to <31>, wherein a content of the polyester resin segment (a1) in the composite resin is preferably not less than 40% by mass, more preferably not less than 45% by mass and even more preferably not less than 55% by mass, and is also preferably not more than 90% by mass, more preferably not more than 85% by mass and even more preferably not more than 80% by mass; and a content of the vinyl-based resin segment (a2) in the composite resin is preferably not less than 5% by mass, more preferably not less than 10% by mass and even more preferably not less than 15% by mass, and is also preferably not more than 60% by mass, more preferably not more than 55% by mass and even more preferably not more than 45% by mass.

<33> The process for producing a toner for development of electrostatic images according to any one of the above aspects <1> to <32>, wherein a softening point of the composite resin is preferably not lower than 70° C., more preferably not lower than 75° C., even more preferably not lower than 80° C. and further even more preferably not lower than 85° C., and is also preferably not higher than 140° C., more preferably not higher than 135° C., even more preferably not higher than 130° C. and further even more preferably not higher than 125° C.

<34> The process for producing a toner for development of electrostatic images according to any one of the above aspects <1> to <33>, wherein a glass transition temperature of the composite resin is preferably not lower than 30° C., more preferably not lower than 35° C. and even more preferably not lower than 40° C., and is also preferably not higher than 75° C., more preferably not higher than 70° C. and even more preferably not higher than 65° C.

<35> The process for producing a toner for development of electrostatic images according to any one of the above aspects <1> to <34>, wherein an acid value of the composite resin is preferably not less than 5 mgKOH/g, more preferably not less than 10 mgKOH/g and even more preferably not less than 12 mgKOH/g, and is also preferably not more than 40 mgKOH/g, more preferably not more than 35 mgKOH/g and even more preferably not more than 30 mgKOH/g.

<36> The process for producing a toner for development of electrostatic images according to any one of the above aspects <1> to <35>, wherein the water dispersion of the resin particles (A) is produced by mixing the composite resin, if required, together with a surfactant and optional components, in an aqueous medium.

<37> The process for producing a toner for development of electrostatic images according to any one of the above aspects <1> to <36>, wherein the water dispersion of the resin particles (A) is produced by a method of adding the aqueous medium to a solution prepared by dissolving the composite resin and, if required, the optional components, in an organic solvent to subject the resulting solution to phase inversion emulsification.

<38> The process for producing a toner for development of electrostatic images according to the above aspect <37>, wherein a content of the surfactant in the water dispersion of the resin particles (A) is preferably not more than 20 parts by mass, more preferably not more than 10 parts by mass, even more preferably not more than 5 parts by mass and further even more preferably not more than 2 parts by mass, and is also preferably not less than 0.1 part by mass, more preferably not less than 0.5 part by mass and even more preferably not less than 1 part by mass, on the basis of 100 parts by mass of the resin constituting the resin particles (A).

<39> The process for producing a toner for development of electrostatic images according to the above aspect <37> or <38>, wherein a mass ratio of the organic solvent to components constituting the resin particles (A) (organic solvent/resin particles (A)) is preferably not less than 0.1, more preferably not less than 0.5 and even more preferably not less than 0.8, and is also preferably not more than 4, more preferably not more than 3 and even more preferably not more than 2.

<40> The process for producing a toner for development of electrostatic images according to any one of the above aspects <37> to <39>, wherein an amount of the aqueous medium used is preferably not less than 100 parts by mass, more preferably not less than 200 parts by mass and even more preferably not less than 300 parts by mass, and is also preferably not more than 900 parts by mass, more preferably not more than 800 parts by mass and even more preferably not more than 600 parts by mass, on the basis of 100 parts by mass of the resin constituting the resin particles (A).

<41> The process for producing a toner for development of electrostatic images according to any one of the above aspects <1> to <40>, wherein a degree (mol %) of neutralization of the composite resin is preferably not less than 10 mol % and more preferably not less than 30 mol %, and is also preferably not more than 150 mol %, more preferably not more than 120 mol % and even more preferably not more than 100 mol %.

<42> The process for producing a toner for development of electrostatic images according to any one of the above aspects <1> to <41>, wherein a volume average particle size ($D_v$) of the resin particles (A) in the water dispersion of the resin particles (A) is preferably not less than 0.02 μm, more preferably not less than 0.03 μm and even more preferably not less than 0.04 μm, and is also preferably not more than 1.00 μm, more preferably not more than 0.50 μm, even more preferably not more than 0.20 μm, further even more preferably not more than 0.10 μm, still further even more preferably not more than 0.09 μm and still further even more preferably not more than 0.08 μm.

<43> The process for producing a toner for development of electrostatic images according to any one of the above aspects <1> to <42>, wherein the water dispersion of the releasing agent particles is obtained by dispersing the releasing agent, the resin particles (A) and, if required, the aqueous medium at a temperature not lower than a melting point of the releasing agent using a disperser.

<44> The process for producing a toner for development of electrostatic images according to any one of the above aspects <1> to <43>, wherein a ratio of the volume median particle size ($D_{50}$) of the releasing agent particles to the volume average particle size ($D_v$) of the resin particles (A) [volume median particle size ($D_{50}$) of releasing agent particles/volume average particle size ($D_v$) of resin particles (A)] is preferably not less than 1.0, more preferably not less than 3.0 and even more preferably not less than 5.0, and is also preferably not more than 50, more preferably not more than 30, even more preferably not more than 15, further even more preferably not more than 12, still further even more preferably not more than 10 and still further even more preferably not more than 8.5.

<45> The process for producing a toner for development of electrostatic images according to any one of the above aspects <1> to <44>, wherein an amount of the releasing agent particles used in the step (2) is preferably not less than 0.1 part by mass, more preferably not less than 0.5 part by mass, even more preferably not less than 1 part by mass and further even more preferably not less than 3 parts by mass, and is also preferably not more than 15 parts by mass, more preferably not more than 10 parts by mass, even more preferably not more than 8 parts by mass and further even more preferably not more than 6 parts by mass, on the basis of 100 parts by mass of a whole amount of the resin particles (B) used in the step (2).

<46> The process for producing a toner for development of electrostatic images according to any one of the above aspects <1> to <45>, wherein a content of the polyester resin segment (b1) in the resin constituting the resin particles (B) is not less than 50% by mass, preferably not less than 55% by mass, more preferably not less than 58% by mass and even more preferably not less than 60% by mass.

<47> The process for producing a toner for development of electrostatic images according to any one of the above aspects <1> to <46>, wherein a total content of the polyester resin and the composite resin in the resin constituting the resin particles (B) is preferably not less than 80% by mass, more preferably not less than 90% by mass, even more preferably not less than 95% by mass, further even more preferably not less than 98% by mass and still further even more preferably 100% by mass.

<48> The process for producing a toner for development of electrostatic images according to any one of the above aspects <1> to <47>, wherein the resin constituting the resin particles (B) contains a polyester resin; the raw material monomers constituting the polyester resin include an alcohol component and an acid component; and the carboxylic acid component is at least one compound selected from the group consisting of an aliphatic dicarboxylic acid, an aromatic dicarboxylic acid, a trivalent or higher-valent polycarboxylic acid, and an anhydride and an alkyl (having not less than 1 and not more than 3 carbon atoms) ester of these acids.

<49> The process for producing a toner for development of electrostatic images according to the above aspect <48>, wherein the aliphatic dicarboxylic acid is preferably at least one acid selected from the group consisting of fumaric acid, adipic acid, a substituted succinic acid containing an alkenyl group having not less than 2 and not more than 20 carbon atoms as a substituent group, sebacic acid, succinic acid and a anhydride of these acids, and more preferably at least one acid selected from the group consisting of fumaric acid, adipic acid and an anhydride of the substituted succinic acid containing an alkenyl group having not less than 2 and not more than 20 carbon atoms as a substituent group.

<50> The process for producing a toner for development of electrostatic images according to the above aspect <48> or <49>, wherein the aromatic dicarboxylic acid is preferably at least one acid selected from the group consisting of phthalic acid, isophthalic acid and terephthalic acid, more preferably the acid component contains the aromatic dicarboxylic acid, and even more preferably terephthalic acid.

<51> The process for producing a toner for development of electrostatic images according to any one of the above aspects <48> to <50>, wherein the trivalent or higher-valent polycarboxylic acid is an aromatic polycarboxylic acid, preferably a trivalent or higher-valent aromatic polycarboxylic acid, more preferably at least one acid selected from the group consisting of trimellitic acid, 2,5,7-naphthalene-tricarboxylic acid and pyromellitic acid, even more preferably at least one acid selected from the group consisting of trimellitic acid and trimellitic anhydride, and further even more preferably trimellitic anhydride.

<52> The process for producing a toner for development of electrostatic images according to any one of the above aspects <48> to <51>, wherein a content of the aliphatic dicarboxylic acid component in the acid component constituting the polyester resin is preferably not less than 10% by mass, more preferably not less than 15% by mass and even more preferably not less than 20% by mass, and is also preferably not more than 97% by mass, more preferably not more than 95% by mass and even more preferably not more than 93% by mass.

<53> The process for producing a toner for development of electrostatic images according to any one of the above aspects <1> to <52>, wherein the resin constituting the resin particles (B) contains a polyester resin; the raw material monomers constituting the polyester resin include an alcohol component and an acid component; the alcohol component is an aromatic diol, an aliphatic diol having not less than 2 and not more than 12 main-chain carbon atoms, an alicyclic diol, a trivalent or higher-valent polyhydric alcohol or an alkylene (having not less than 2 and not more than 4 carbon atoms) oxide adducts (average molar number of addition of alkyleneoxide; not less than 1 and not more than 16) of these alcohol components, preferably an aromatic diol or an alicyclic diol, and more preferably an alkylene (having not less than 2 and not more than 3 carbon atoms) oxide adduct (average molar number of addition of alkyleneoxide; not less than 1 and not more than 16) of bisphenol A such as polyoxypropylene-2,2-bis(4-hydroxyphenyl)propane and polyoxyethylene-2,2-bis(4-hydroxyphenyl)propane; and a content of the aromatic diol in the alcohol component is preferably not less than 60 mol %, more preferably not less than 80 mol %, even more preferably not less than 90 mol %, further even more preferably not less than 95 mol % and still further even more preferably 100 mol %.

<54> The process for producing a toner for development of electrostatic images according to any one of the above aspects <1> to <53>, wherein a softening point of the resin constituting the resin particles (B) is preferably not lower than 80° C., more preferably not lower than 85° C. and even more preferably not lower than 88° C., and is also preferably not higher than 110° C., more preferably not higher than 105° C., even more preferably not higher than 100° C. and further even more preferably not higher than 95° C.

<55> The process for producing a toner for development of electrostatic images according to any one of the above aspects <1> to <54>, wherein a glass transition temperature of the resin constituting the resin particles (B) is preferably not lower than 30° C., more preferably not lower than 32° C. and even more preferably not lower than 35° C., and is also preferably not higher than 60° C., more preferably not higher than 55° C. and even more preferably not higher than 50° C.

<56> The process for producing a toner for development of electrostatic images according to any one of the above aspects <1> to <55>, wherein an acid value of the resin constituting the resin particles (B) is preferably not less than 5 mgKOH/g, more preferably not less than 6 mgKOH/g, even more preferably not less than 8 mgKOH/g and further even more preferably not less than 10 mgKOH/g, and is also preferably not more than 35 mgKOH/g, more preferably not more than 32 mgKOH/g and even more preferably not more than 30 mgKOH/g.

<57> The process for producing a toner for development of electrostatic images according to any one of the above aspects <1> to <56>, wherein a total content of the acid component and the alcohol component in the components from which the constitutional units of the polyester resin segment (b1) are derived is preferably not less than 80% by mass, more preferably not less than 90% by mass, even more preferably not less than 95% by mass, further even more preferably not less than 98% by mass and still further even more preferably 100% by mass.

<58> The process for producing a toner for development of electrostatic images according to any one of the above aspects <1> to <57>, wherein a proportion of the acid component to 100 mole parts of the alcohol component in the components from which the constitutional units of the polyester resin segment (b1) are derived is preferably not less than 70 mole parts, more preferably not less than 75 mole parts and even more preferably not less than 80 mole parts, and is also preferably not more than 120 mole parts, more preferably not more than 110 mole parts and even more preferably not more than 105 mole parts.

<59> The process for producing a toner for development of electrostatic images according to any one of the above aspects <1> to <58>, wherein the water dispersion of the resin particles (B) is produced by a method using phase inversion emulsification.

<60> The process for producing a toner for development of electrostatic images according to any one of the above aspects <1> to <59>, wherein an amount of the surfactant used on the basis of 100 parts by mass of the resin particles (B) is preferably not less than 0% by mass, more preferably not less than 0.5% by mass and even more preferably not less than 1% by mass, and is also preferably not more than 20% by mass, more preferably not more than 10% by mass and even more preferably not more than 5% by mass.

<61> The process for producing a toner for development of electrostatic images according to any one of the above aspects <1> to <60>, wherein a volume median particle size ($D_{50}$) of the resin particles (B) contained in the water dispersion of the resin particles (B) is preferably not less than 0.02 μm, more preferably not less than 0.05 μm and even more preferably not less than 0.08 μm, and is also preferably not more than 1.00 μm, more preferably not more than 0.50 μm and even more preferably not more than 0.30 μm.

<62> The process for producing a toner for development of electrostatic images according to any one of the above aspects <1> to <61>, wherein in the step (2), a colorant is dispersed in an aqueous medium to prepare a colorant dispersion, and the thus prepared colorant dispersion is added in the step (2) to obtain aggregated particles (1).

<63> The process for producing a toner for development of electrostatic images according to any one of the above aspects <1> to <62>, wherein the step (2) may include the following step (2A), and may further include the following step (2B) subsequent to the step (2A):

step (2A): mixing the water dispersion of the releasing agent particles obtained in the step (1), the water dispersion of the resin particles (B) and an aggregating agent with each other in an aqueous medium to obtain aggregated particles (1); and step (2B): adding the resin particles (B) to the aggregated particles (1) obtained in the step (2A) at one time or plural times in a split addition manner to obtain aggregated particles (2) formed by adhering the resin particles (B) onto the aggregated particles (1) (resin particle (B)-adhered aggregated particles).

<64> The process for producing a toner for development of electrostatic images according to the above aspect <63>, wherein in the step (2A), the water dispersion of the releasing agent particles and a water dispersion of resin particles (B1) (meanwhile, the resin particles (B) added in the step (2A) are also referred to as the resin particles (B1) in some cases) as well as, if required, the aggregating agent, the colorant and the aqueous medium, are added and mixed with each other to obtain a water dispersion of the aggregated particles (1).

<65> The process for producing a toner for development of electrostatic images according to the above aspect <63> or <64>, wherein the colorant is preferably added in one or both of the step (2A) and the step (2B), and it is more preferred that the colorant is added in the step (2A), and no colorant is added in the step (2B).

<66> The process for producing a toner for development of electrostatic images according to any one of the above aspects <63> to <65>, wherein a content of the colorant in the water dispersion is preferably not less than 2 parts by mass and more preferably not less than 3 parts by mass, and is also preferably not more than 20 parts by mass and more preferably not more than 10 parts by mas, on the basis of 100 parts by mass of the resin particles (B1).

<67> The process for producing a toner for development of electrostatic images according to any one of the above aspects <63> to <66>, wherein a volume median particle size ($D_{50}$) of the aggregated particles (2) is preferably not less than 2 μm, more preferably not less than 3 μm and even more preferably not less than 4 μm, and is also preferably not more than 10 μm, more preferably not more than 9 μm and even more preferably not more than 8 μm.

<68> The process for producing a toner for development of electrostatic images according to any one of the above aspects <63> to <67>, wherein an amount of a fine powder in the aggregated particles (2) is preferably not more than 10% by mass, more preferably not more than 8% by mass and even more preferably not more than 5% by mass.

<69> The process for producing a toner for development of electrostatic images according to any one of the above aspects <63> to <68>, wherein a content of the releasing agent particles in the water dispersion is preferably not less than 2 parts by mass and more preferably not less than 5 parts by mass, and is also preferably not more than 20 parts by mass and more preferably not more than 15 parts by mass, on the basis of 100 parts by mass of the resin particles (B1).

<70> The process for producing a toner for development of electrostatic images according to any one of the above aspects <1> to <69>, wherein in the step (2), the aggregated particles are obtained using the aggregating agent, and an amount of the aggregating agent used is preferably not less than 1 parts by mass, more preferably not less than 10 parts by mass and even more preferably not less than 20 parts by mass, and is also preferably not more than 50 parts by mass, more preferably not more than 40 parts by mass and even more preferably not more than 35 parts by mass, on the basis of 100 parts by mass of the resin constituting the resin particles (B).

<71> The process for producing a toner for development of electrostatic images according to any one of the above aspects <62> to <70>, wherein a volume median particle size ($D_{50}$) of the aggregated particles (1) produced is preferably not more than 15 μm, more preferably not more than 10 μm and even more preferably not more than 8 μm, and is also preferably not less than 1 μm, more preferably not less than 2 μm and even more preferably not less than 3 μm.

<72> The process for producing a toner for development of electrostatic images according to any one of the above aspects <62> to <71>, wherein an amount of a fine powder in the aggregated particles (1) is preferably not more than 10% by mass, more preferably not more than 8% by mass and even more preferably not more than 5% by mass.

<73> The process for producing a toner for development of electrostatic images according to any one of the above aspects <1> to <72>, wherein a volume median particle size (1150) of the coalesced particles is preferably not less than 2 μm, more preferably not less than 3 μm and even more preferably not less than 4 μm, and is also preferably not more than 20 μm, more preferably not more than 15 μm, even more preferably not more than 10 μm and further even more preferably not more than 8 μm.

<74> The process for producing a toner for development of electrostatic images according to any one of the above aspects <63> to <72>, wherein an amount of a fine powder in the toner particles or the toner is preferably not more than 10% by mass, more preferably not more than 8% by mass and even more preferably not more than 5% by mass, and an amount of change between the amount of the fine powder in the aggregated particles (2) and the amount of the fine powder in the toner particles or the toner is preferably not more than 10% by mass, more preferably not more than 5% by mass, even more preferably not more than 3% by mass and further even more preferably not more than 1% by mass.

<75> The process for producing a toner for development of electrostatic images according to any one of the above aspects <1> to <74>, wherein an amount of change between the amount of the fine powder in the aggregated particles obtained in the step (2) and the amount of the fine powder in the toner particles or the toner is preferably not more than 10% by mass, more preferably not more than 5% by mass, even more preferably not more than 3% by mass and further even more preferably not more than 1% by mass.

<76> A process for producing a water dispersion of releasing agent particles, including the following step (1):

step (1): mixing a releasing agent and a water dispersion of resin particles (A) to obtain the water dispersion of the releasing agent particles, in which the resin particles (A) include a composite resin including a segment (a1) constituted of a polyester resin and a vinyl-based resin segment (a2) containing a constitutional unit derived from a styrene-based compound in an amount of not less than 90% by mass.

EXAMPLES

Respective properties of composite resins, polyester resins, rein particles, toners, etc., were measured and evaluated by the following methods. [Acid Value of Resin] The acid value of the resin was measured by the same method as prescribed in JIS K0070 except that a mixed solvent containing acetone and toluene at a volume ratio (acetone: toluene) of 1:1 was used as a solvent for the measurement.

[Softening Point of Resin]

Using a flow tester "CFT-500D" available from Shimadzu Corporation, 1 g of a sample was extruded through a nozzle having a die pore diameter of 1 mm and a length of 1 mm while heating the sample at a temperature rise rate of 6° C./minute and applying a load of 1.96 MPa thereto by a plunger. The softening point was determined as the temperature at which a half amount of the sample was flowed out when plotting a downward movement of the plunger of the flow tester relative to the temperature.

[Glass Transition Temperature of Resin]

Using a differential scanning calorimeter "Q-20" available from TA Instruments Japan Inc., a sample was weighed in an amount of 0.01 to 0.02 g in an aluminum pan, heated to 200° C. and then cooled from 200° C. to 0° C. at a temperature drop rate of 10° C./minute, and then the sample was further heated at a temperature rise rate of 10° C./minute to measure an endothermic heat amount thereof. Among the endothermic peaks observed in the thus measured characteristic curve, the temperature of the peak having a largest peak area was regarded as an endothermic maximum peak temperature. The temperature at which an extension of the baseline below the endothermic maximum peak temperature was intersected with a tangential line having a maximum inclination in the region from a rise-up portion to an apex of the peak was read as a glass transition temperature of the sample.

[Melting Point of Releasing Agent]

Using a differential scanning calorimeter "Q-20" available from TA Instruments Japan Inc., a sample was weighed in an amount of 0.01 to 0.02 g in an aluminum pan, heated to 200° C. and then cooled from 200° C. to 0° C. at a temperature drop rate of 10° C./minute, and then the sample was further heated at a temperature rise rate of 10° C./min to measure an endothermic heat amount thereof. The endothermic maximum peak temperature observed in the thus measured characteristic curve was regarded as a melting point of the sample.

[Volume Average Particle Size ($D_v$) of Resin Particles (A)]

(1) Measuring Apparatus: Zeta potential particle size analyzing system "ELSZ-2" commercially available from Otsuka Electrics Co., Ltd.

(2) Measuring Conditions: In a cell for the measurement which was filled with distilled water, a volume average particle size of the particles was measured at a concentration at which an absorbance thereof fell within an adequate range.

[Volume Median Particle Sizes ($D_{50}$) of Resin Particles (B), Releasing Agent Particles and Colorant Particles]

(1) Measuring Apparatus: Laser diffraction particle size analyzer "LA-920" commercially available from HORIBA Ltd.

(2) Measuring Conditions: In a cell for the measurement which was filled with distilled water, a volume median particle size ($D_{50}$) of the particles was measured at a concentration at which an absorbance thereof fell within an adequate range.

[Solid Contents of Water Dispersion of Resin Particles, Water Dispersion of Releasing Agent Particles and Colorant Dispersion]

Using an infrared moisture meter "FD-230" available from Kett Electric Laboratory, 5 g of a sample to be measured was subjected to measurement of a water content (% by mass) thereof at a drying temperature of 150° C. under a measuring mode 96 (monitoring time: 2.5 minutes/variation range: 0.05%). The solid contents of the respective dispersions were calculated according to the following formula:

Solid Content (% by mass)=100−Water Content (% by mass).

[Volume Median Particle Sizes ($D_{50}$) of Aggregated Particles (1), Aggregated Particles (2) and Coalesced Particles]

The volume median particle sizes ($D_{50}$) of the aforementioned respective particles were measured as follows.

Measuring Apparatus: "Coulter Multisizer III" commercially available from Beckman Coulter Inc.

Aperture Diameter: 50 μm

Analyzing Software: "Multisizer III Ver. 3.51" commercially available from Beckman Coulter Inc.

Electrolyte Solution: "Isotone II" commercially available from Beckman Coulter Inc.

Measuring Conditions:

A concentration of a resultant dispersion is adjusted to the concentration permitting the measurement for particle sizes of 30000 particles within 20 seconds, by adding a sample dispersion containing the aggregated particles to 100 mL of the electrolyte solution. And then, the particle sizes of the 30000 particles in the resultant dispersion were measured under the concentration, and the volume median particle size ($D_{50}$) of the particles were determined from a particle size distribution thereof.

[Circularity of Coalesced Particles]

Using a flow-type particle image analyzer "FPIA-3000" available from Sysmex Corporation, the circularity of the coalesced particles was measured under the following conditions.

Preparation of Dispersion:

The water dispersion of the coalesced particles was diluted with deionized water such that the solid content of the resulting diluted dispersion was in the range of 0.001 to 0.05% by mass.

Measuring Mode: HPF measuring mode

[Volume Median Particle Size ($D_{50}$) of Toner Particles]

The volume median particle size ($D_{50}$) of the toner particles was measured as follows.

The same measuring apparatus, aperture diameter, analyzing software and electrolyte solution as used for measuring the volume median particle size ($D_{50}$) of the aggregated particles were used.

Dispersing Solution:

A polyoxyethylene lauryl ether "EMULGEN 109P" (HLB: 13.6) commercially available from Kao Corporation was dissolved in the aforementioned electrolyte solution to prepare a dispersing solution having a concentration of 5% by mass.

Dispersing Conditions

Ten milligrams of a toner sample to be measured were added to 5 mL of the aforementioned dispersing solution, and dispersed therein using an ultrasonic disperser for 1 minute. Thereafter, 25 mL of the electrolyte solution was added to the resulting dispersion, and the obtained mixture was further dispersed using the ultrasonic disperser for 1 minute to prepare a sample dispersion.

Measuring Conditions:

A concentration of a resultant dispersion is adjusted to the concentration permitting the measurement for particle sizes of 30000 particles within 20 seconds, by adding the sample dispersion to 100 mL of the electrolyte solution. And then, the particle sizes of the 30000 particles in the resultant dispersion were measured under the concentration, and the volume median particle size ($D_{50}$) of the particles were determined from a particle size distribution thereof.

[Amount of Releasing Agent Desorbed]

The particles having a particle size of not more than 2 μm in the toner particles were regarded as a fine powder, and the amount of change in an amount of the fine powder included in the toner particles between before and after the coalescing step was calculated according to the following formula.

Amount of Change in Amount of Fine Powder= (Amount of Fine Powder in Toner Particles (% by mass))−(Amount of Fine Powder in Aggregated Particles (2) (% by mass))

The amount of the fine powder in the respective particles was determined upon measuring the volume median particle size ($D_{50}$) of the respective particles. As the numeral value of the amount of change in the amount of the fine powder is reduced, the releasing agent can be more effectively prevented from suffering from desorption thereof in the coalescing step.

[Solid-Image Followup Ability of Toner]

The toner was loaded into a non-magnetic one-component developing device "Microline (registered trademark) 5400" available from Oki Data Corporation. The developing device was allowed to stand under environmental conditions of a temperature of 25° C. and a relative humidity of 50% RH for 12 hours. Thereafter, 100% solid image printing was continuously conducted on 10 sheets of a wood-free paper "J Paper A4 Size" available from Fuji Xerox Co., Ltd., while feeding each sheet in the longitudinal direction of the A4 paper. The rate of reduction in image density of a central portion of the 10th sheet relative to that of the 1st sheet was calculated according to the following formula to evaluate solid-image followup ability of the toner. The smaller the numeral value as calculated, the more excellent the solid-image followup ability of the toner.

Solid-Image Followup Ability (%)=((Image Density of Central Portion of 1st Sheet−Image Density of Central Portion of 10th Sheet)/Image Density of Central Portion of 1st Sheet)×100

Production of Resins

Production Example 1

(Production of Composite Resin X-1)

An inside atmosphere of a four-necked flask equipped with a nitrogen inlet tube, a dehydration tube, a stirrer and a thermocouple was replaced with nitrogen, and 4,313 g of polyoxypropylene (2.2)-2,2-bis(4-hydroxyphenyl)propane, 818 g of terephthalic acid, 727 g of succinic acid, 30 g of tin (II) di(2-ethyl hexanoate) and 3 g of gallic acid (same as 3,4,5-trihydroxybenzoic acid) were charged into the flask. The contents of the flask were heated to 235° C. in a nitrogen atmosphere while stirring and maintained at 235° C. for 5 hours, and then the pressure within the flask was reduced and maintained under 8 kPa for 1 hour. Thereafter, the contents of the flask were cooled to 160° C., and while maintaining the contents of the flask at 160° C., a mixture of 2,756 g of styrene, 689 g of stearyl methacrylate, 142 g of acrylic acid and 413 g of dibutyl peroxide was added dropwise thereto over 1 hour. Thereafter, the contents of the flask were heated to 200° C. and reacted at that temperature under 8 kPa until the softening point thereof reached a desired temperature, thereby obtaining a composite resin X-1. The properties of the thus obtained composite resin X-1 are shown in Table 1.

Production Example 2

(Production of Composite Resin X-2)

An inside atmosphere of a four-necked flask equipped with a nitrogen inlet tube, a dehydration tube, a stirrer and a thermocouple was replaced with nitrogen, and 5,589 g of polyoxypropylene (2.2)-2,2-bis(4-hydroxyphenyl)propane, 1,856 g of terephthalic acid, 50 g of tin (II) di(2-ethyl hexanoate) and 5 g of gallic acid were charged into the flask. The contents of the flask were heated to 235° C. in a nitrogen atmosphere while stirring and maintained at 235° C. for 5 hours, and then the pressure within the flask was reduced and maintained under 8 kPa for 1 hour. Thereafter, the contents of the flask were cooled to 160° C., and a mixture of 1,465 g of styrene, 322 g of 2-ethylhexyl acrylate, 92 g of acrylic acid and 71 g of dibutyl peroxide was added dropwise thereto over 1 hour. Thereafter, the contents of the flask were maintained at 160° C. for 30 minutes and then heated to 200° C., and further the pressure within the flask was reduced and maintained under 8 kPa for 1 hour. Then, after the pressure within the flask was returned to atmospheric pressure, the contents of the flask were cooled to 190° C., and 463 g of fumaric acid and 2 g of 4-tert-butyl catechol were added to the flask. The contents of the flask were heated to 210° C. over 3 hours and then reacted at that temperature under 40 kPa until the softening point thereof reached a desired temperature, thereby obtaining a composite resin X-2. The properties of the thus obtained composite resin X-2 are shown in Table 1.

Production Example 3

(Production of Composite Resin X-3)

An inside atmosphere of a four-necked flask equipped with a nitrogen inlet tube, a dehydration tube, a stirrer and a thermocouple was replaced with nitrogen, and 3,323 g of polyoxypropylene (2.2)-2,2-bis(4-hydroxyphenyl)propane, 441 g of terephthalic acid, 25 g of tin (II) di(2-ethyl hexanoate) and 2.5 g of gallic acid were charged into the flask. The contents of the flask were heated to 235° C. in a nitrogen atmosphere while stirring and maintained at 235° C. for 5 hours, and then the pressure within the flask was reduced and maintained under 8 kPa for 3 hours. Thereafter, the contents of the flask were cooled to 160° C., and while maintaining the contents of the flask at 160° C., a mixture of 2,207 g of styrene, 552 g of stearyl methacrylate, 109 g of acrylic acid and 331 g of dibutyl peroxide was added dropwise thereto over 1 hour. Thereafter, the contents of the flask were heated to 200° C. and maintained under 8 kPa for 1 hour. Then, after the pressure within the flask was returned to atmospheric pressure, the contents of the flask were cooled to 160° C., and 176 g of fumaric acid, 767 g of sebacic acid, 182 g of trimellitic anhydride and 2.5 g of 4-tert-butyl catechol were added to the flask. The contents of the flask were heated to 210° C. and then reacted at that temperature under 8 kPa until the softening point thereof reached a desired temperature, thereby obtaining a composite resin X-3. The properties of the thus obtained composite resin X-3 are shown in Table 1.

Production Example 4

(Production of Polyester Resin Y-1)

An inside atmosphere of a four-necked flask equipped with a nitrogen inlet tube, a dehydration tube, a stirrer and a thermocouple was replaced with nitrogen, and 3,250 g of polyoxyethylene (2.2)-2,2-bis(4-hydroxyphenyl)propane, 830 g of terephthalic acid and 24 g of tin (II) di(2-ethyl hexanoate) were charged into the flask. The contents of the flask were heated to 235° C. in a nitrogen atmosphere while stirring and maintained at 235° C. for 5 hours, and then the pressure within the flask was reduced and maintained under 8 kPa for 4 hours. Then, the contents of the flask were cooled to 210° C., and after the pressure within the flask was returned to atmospheric pressure, 438 g of adipic acid and 192 g of trimellitic anhydride were added thereto, and then the pressure within the flask was reduced and maintained under 8 kPa at a temperature of 210° C. for 4 hours, thereby obtaining a polyester resin Y-1. The properties of the thus obtained polyester resin Y-1 are shown in Table 1.

Production Example 5

(Production of Polyester Resin Y-2)

An inside atmosphere of a four-necked flask equipped with a nitrogen inlet tube, a dehydration tube, a stirrer and a thermocouple was replaced with nitrogen, and 6,364 g of polyoxypropylene (2.2)-2,2-bis(4-hydroxyphenyl)propane, 1,509 g of terephthalic acid, 30 g of tin (II) di(2-ethyl hexanoate) and 3 g of gallic acid were charged into the flask. The contents of the flask were heated to 235° C. in a nitrogen atmosphere while stirring and maintained at 235° C. for 5 hours, and then the pressure within the flask was reduced and maintained under 8 kPa for 9 hours. Then, the contents of the flask were cooled to 200° C., and after the pressure within the flask was returned to atmospheric pressure, 1,949 g of dodecenyl succinic anhydride and 244 g of trimellitic anhydride were added thereto, followed by heating the contents of the flask to 210° C. Then, the pressure within the flask was reduced and maintained under 20 kPa for 2 hours, thereby obtaining a polyester resin Y-2. The properties of the thus obtained polyester resin Y-2 are shown in Table 1.

Production Example 6

(Production of Polyester Resin Y-3)

An inside atmosphere of a four-necked flask equipped with a nitrogen inlet tube, a dehydration tube, a stirrer and a thermocouple was replaced with nitrogen, and 4,381 g of polyoxypropylene (2.2)-2,2-bis(4-hydroxyphenyl)propane, 951 g of fumaric acid, 548 g of adipic acid, 12 g of tin (II) di(2-ethyl hexanoate) and 3 g of 4-tert-butyl catechol were charged into the flask. The contents of the flask were heated to 210° C. in a nitrogen atmosphere while stirring and maintained at 210° C. for 7 hours. Then, the contents of the flask were cooled to 200° C., and after the pressure within the flask was returned to atmospheric pressure, 120 g of trimellitic anhydride was added thereto, followed by heating the contents of the flask to 210° C. Then, the pressure within the flask was reduced and maintained under 10 kPa for 2 hours, thereby obtaining a polyester resin Y-3. The properties of the thus obtained polyester resin Y-3 are shown in Table 1.

Production Example 7

(Production of Polyester Resin Y-4)

An inside atmosphere of a four-necked flask equipped with a nitrogen inlet tube, a dehydration tube, a stirrer and a thermocouple was replaced with nitrogen, and 5,498 g of polyoxypropylene (2.2)-2,2-bis(4-hydroxyphenyl)propane, 942 g of 2,2'-bis(4-hydroxycyclohexyl)propane, 2,282 g of terephthalic acid, 50 g of tin (II) di(2-ethyl hexanoate) and 5 g of gallic acid were charged into the flask. The contents of the flask were heated to 235° C. in a nitrogen atmosphere while stirring and maintained at 235° C. for 5 hours, and then the pressure within the flask was reduced and maintained under 8 kPa for 5 hours. Then, the contents of the flask were cooled to 200° C., and after the pressure within the flask was returned to atmospheric pressure, 1,052 g of dodecenyl succinic anhydride and 226 g of trimellitic anhydride were added thereto, followed by heating the contents of the flask to 220° C. Then, the pressure within the flask was reduced and maintained under 50 kPa for 3 hours, thereby obtaining a polyester resin Y-4. The properties of the thus obtained polyester resin Y-4 are shown in Table 1.

Production Example 8

(Production of Polyester Resin Y-5)

An inside atmosphere of a four-necked flask equipped with a nitrogen inlet tube, a dehydration tube, a stirrer and a thermocouple was replaced with nitrogen, and 6,530 g of polyoxyethylene (2.2)-2,2-bis(4-hydroxyphenyl)propane, 2,668 g of terephthalic acid, 20 g of tin (II) di(2-ethyl hexanoate) and 2 g of gallic acid were charged into the flask. The contents of the flask were heated to 235° C. in a nitrogen atmosphere while stirring and maintained at 235° C. for 5 hours, and then the pressure within the flask was reduced and maintained under 8 kPa for 2 hours. Then, the contents of the flask were cooled to 200° C., and after the pressure within the flask was returned to atmospheric pressure, 147 g of adipic acid, 269 g of dodecenyl succinic anhydride and 386 g of trimellitic anhydride were added thereto, followed by heating the contents of the flask to 210° C. Then, the pressure within the flask was reduced and maintained under 8 kPa for 4 hours, thereby obtaining a polyester resin Y-5. The properties of the thus obtained polyester resin Y-5 are shown in Table 1.

Production Example 9

(Production of Styrene-Acrylic Resin Z-1)

An inside atmosphere of a four-necked flask equipped with a nitrogen inlet tube, a dehydration tube, a stirrer and a thermocouple was replaced with nitrogen, and 200 g of xylene was charged into the flask, heated to 130° C. and then refluxed through the flask. Then, a mixture of 77 g of styrene, 34 g of acrylic acid, 19 g of stearyl methacrylate and 4 g of dibutyl peroxide was added dropwise through a dropping funnel into the flask over 2 hours. While maintaining the contents of the flask at 130° C., they were further polymerized under reflux for 2 hours, and the solvent was removed therefrom by distillation under reduced pressure, thereby obtaining a styrene-acrylic resin Z-1. The properties of the thus obtained styrene-acrylic resin Z-1 are shown in Table 1.

TABLE 1

| Resin | Production Example 1 X-1 | | Production Example 2 X-2 | | Production Example 3 X-3 | | Production Example 4 Y-1 | | Production Example 5 Y-2 | | Production Example 6 Y-3 | | Production Example 7 Y-4 | | Production Example 8 Y-5 | | Production Example 9 Z-1 | |
|---|---|---|---|---|---|---|---|---|---|---|---|---|---|---|---|---|---|---|
| Raw material monomers (A) of polyester segment | g | mole parts *2 | g | mole parts *2 | g | mole parts *2 | g | mole parts *2 | g | mole parts *2 | g | mole parts *2 | g | mole parts *2 | g | mole parts *2 | g | mole parts *2 |
| Alcohol component | | | | | | | | | | | | | | | | | | |
| BPA-PO(*1) | 4313 | 100 | 5589 | 100 | 3323 | 100 | | | 6364 | 100 | 4381 | 100 | 5498 | 80 | — | — | — | — |
| BPA-EO(*1) | — | — | — | — | — | — | 3250 | 100 | — | — | — | — | — | — | 6530 | 100 | — | — |
| HBPA(*1) | — | — | — | — | — | — | — | — | — | — | — | — | 942 | 20 | — | — | — | — |
| Acid component | | | | | | | | | | | | | | | | | | |
| Terephthalic acid | 818 | 40 | 1856 | 70 | 441 | 28 | 830 | 50 | 1509 | 50 | — | — | 2282 | 70 | 2668 | 80 | — | — |
| Fumaric acid | — | — | 463 | 25 | 176 | 16 | — | — | — | — | 951 | 65.5 | — | — | — | — | — | — |
| Sebacic acid | — | — | — | — | 767 | 40 | — | — | — | — | — | — | — | — | — | — | — | — |
| Succinic acid | 727 | 50 | — | — | — | — | — | — | — | — | — | — | — | — | — | — | — | — |
| Dodecenyl succinic anhydride | — | — | — | — | — | — | — | — | 1949 | 40 | — | — | 1052 | 20 | 269 | 5 | — | — |
| Adipic acid | — | — | — | — | — | — | 438 | 30 | — | — | 548 | 30 | — | — | 147 | 5 | — | — |
| Trimellitic anhydride | — | — | — | — | 182 | 10 | 192 | 10 | 244 | 7 | 120 | 5 | 226 | 6 | 386 | 10 | — | — |
| Bireactive monomer | g | mole parts *2 | g | mole parts *2 | g | mole parts *2 | g | mole parts *2 | g | mole parts *2 | g | mole parts *2 | g | mole parts *2 | g | mole parts *2 | g | mole parts *2 |
| Acrylic acid | 142 | 16 | 92 | 8 | 109 | 16 | — | — | — | — | — | — | — | — | — | — | 34 | 16 |
| Raw material monomers (B) of vinyl-based resin segment | g | mass % *3 | g | mass % *3 | g | mass % *3 | g | mass % *3 | g | mass % *3 | g | mass % *3 | g | mass % *3 | g | mass % *3 | g | mass % *3 |
| Styrene | 2756 | 80 | 1465 | 82 | 2207 | 80 | — | — | — | — | — | — | — | — | — | — | 77 | 80 |
| 2-Ethylhexyl acrylate | — | — | 322 | 18 | — | — | — | — | — | — | — | — | — | — | — | — | — | — |
| Stearyl methacrylate | 689 | 20 | — | — | 552 | 20 | — | — | — | — | — | — | — | — | — | — | 19 | 20 |

| Resin | Production Example 1 X-1 | Production Example 2 X-2 | Production Example 3 X-3 | Production Example 4 Y-1 | Production Example 5 Y-2 | Production Example 6 Y-3 | Production Example 7 Y-4 | Production Example 8 Y-5 | Production Example 9 Z-1 |
|---|---|---|---|---|---|---|---|---|---|
| Esterification catalyst | | | | | | | | | |
| Tin (II) di(2-ethyl hexanoate) (g) | 30 | 50 | 25 | 24 | 30 | 12 | 50 | 20 | — |
| Esterification co-catalyst | | | | | | | | | |
| 3,4,5-Trihydroxy benzoate (g) | 3 | 5 | 2.5 | — | 3 | — | 5 | 2 | — |
| Radical Polymerization inhibitor | | | | | | | | | |
| 4-tert-Butyl catechol (g) | — | 2 | 2.5 | — | — | 3 | — | — | — |
| Radical Polymerization initiator | | | | | | | | | |
| Dibutyl peroxide (g) | 413 | 71 | 331 | — | — | — | — | — | 4 |
| Properties, etc. | | | | | | | | | |
| Content of polyester segment in resin (% by mass) | 60 | 80 | 60 | 100 | 100 | 100 | 100 | 100 | 0 |

TABLE 1-continued

| | | | | | | | | | |
|---|---|---|---|---|---|---|---|---|---|
| Softening point (° C.) | 91 | 122 | 99 | 92 | 93 | 90 | 113 | 115 | 95 |
| Glass transition temperature (° C.) | 42 | 63 | 37 | 46 | 49 | 45 | 65 | 64 | 41 |
| Acid value (mgKOH/g) | 24 | 14 | 27 | 17 | 25 | 22 | 19 | 23 | 28 |

Note:

1*: BPA-PO: Polyoxypropylene (2.2)-2,2-bis(4-hydroxyphenyl)propane;

BPA-EO: Polyoxyethylene (2.2)-2,2-bis(4-hydroxyphenyl)propane; and

HBPA: 2,2'-Bis(4-hydroxycyclohexyl)propane.

2*: Mole parts of respective monomers constituting the raw material monomers (A) and the bireactive monomer on the basis of 100 mole parts of an alcohol component in the raw material monomers (A).

3*: Content (% by mass) of respective monomers constituting the raw material monomers (B) on the basis of a total amount of the raw material monomers (B).

(Production of Water Dispersions of Resin Particles)

Production Example 10

(Production of Resin Particle Water Dispersion A-1)

A 3 L-capacity reaction vessel equipped with a stirrer, a reflux condenser, a dropping funnel, a thermometer and a nitrogen inlet tube was charged with 200 g of the composite resin X-1 and 200 g of methyl ethyl ketone, and the contents of the reaction vessel were dissolved at 73° C. over 2 hours. The resulting solution was mixed with a 5% by mass sodium hydroxide aqueous solution such that the degree of neutralization of the composite resin X-1 was 60 mol % relative to an acid value of the composite resin X-1, followed by stirring the mixed solution for 30 minutes.

Next, while maintaining the obtained reaction solution at a temperature of 73° C. and continuously stirring the reaction solution at 200 r/min, 1000 g of deionized water was added thereto over 50 minutes to subject the solution to phase inversion emulsification. While maintaining the resulting solution at a temperature of 73° C., methyl ethyl ketone was removed therefrom by distillation under reduced pressure to obtain a dispersion. Thereafter, while continuously stirring, the thus obtained dispersion was cooled to 30° C., and then deionized water was added thereto such that the solid content of the dispersion was 20% by mass, thereby obtaining a resin particle water dispersion A-1. The properties of the thus obtained resin particle water dispersion A-1 are shown in Table 2.

Production Examples 11 to 14

(Production of Resin Particle Water Dispersions A-2 to A-5)

The same procedure as in Production Example 10 was repeated except that the kinds of resins were changed as shown in Table 2, thereby obtaining resin particle water dispersions A-2 to A-5. The properties of the thus obtained resin particle water dispersions A-2 to A-5 are shown in Table 2.

TABLE 2

| | Production Example 10 | Production Example 11 | Production Example 12 | Production Example 13 | Production Example 14 |
|---|---|---|---|---|---|
| Water dispersion of resin particles | A-1 | A-2 | A-3 | A-4 | A-5 |
| No. of resin | X-1 | X-2 | Y-1 | Y-2 | Z-1 |
| Volume average particle size ($D_v$) of resin particles (μm) | 0.07 | 0.04 | 0.06 | 0.05 | 0.13 |

TABLE 2-continued

| | Production Example 10 | Production Example 11 | Production Example 12 | Production Example 13 | Production Example 14 |
|---|---|---|---|---|---|
| Solid content of water dispersion of resin particles (% by mass) | 20 | 20 | 20 | 20 | 20 |

Production Example 15

(Production of Resin Particle Water Dispersion B-1)

A 2 L-capacity stainless steel reaction vessel was charged with 600.0 g of the polyester resin Y-3, 40.0 g of a 15% by mass sodium dodecylbenzenesulfonate aqueous solution "NEOPELEX G-15" (anionic surfactant) available from Kao Corporation, 6.0 g of polyoxyethylene lauryl ether "EMULGEN 150" (nonionic surfactant; HLB: 18.4) available from Kao Corporation, 23.6 g of a 48% by mass potassium hydroxide aqueous solution and 45.0 g of deionized water, and the contents of the vessel were dispersed at 98° C. while stirring with a paddle-shaped stirrer at 200 r/min (peripheral speed: 1.2 m/sec). Further, the contents of the reaction vessel were maintained for 2 hours while stirring with the paddle-shaped stirrer at 200 r/min (peripheral speed: 1.2 m/sec). Subsequently, while stirring the contents of the reaction vessel with the paddle-shaped stirrer at 200 r/min (peripheral speed: 1.2 m/sec), 1,246.1 g of deionized water was added dropwise thereto at a rate of 6 g/min. In addition, the temperature of the reaction system was maintained at 98° C.

After completion of the dropwise addition, the resulting reaction mixture was allowed to pass through a wire mesh having a 200 mesh screen (opening size: 105 μm), thereby obtaining a resin particle water dispersion B-1 containing atomized resin particles. The properties of the thus obtained resin particle water dispersion B-1 are shown in Table 3.

Production Examples 16 to 19

(Production of Resin Particle Water Dispersions B-2 to B-5)

The same procedure as in Production Example 15 was repeated except that the kinds of resins were changed as shown in Table 3, thereby obtaining resin particle water dispersions B-2 to B-5.

TABLE 3

| | Production Example 15 | Production Example 16 | Production Example 17 | Production Example 18 | Production Example 19 |
|---|---|---|---|---|---|
| Water dispersion of resin particles | B-1 | B-2 | B-3 | B-4 | B-5 |
| No. of resin | Y-3 | Y-1 | X-3 | Y-4 | Y-5 |
| Volume median particle size ($D_{50}$) of resin particles (μm) | 0.22 | 0.09 | 0.13 | 0.24 | 0.21 |
| Solid content of water dispersion of resin particles (% by mass) | 30 | 30 | 30 | 30 | 30 |

[Production of Water Dispersions of Releasing Agent Particles]

Production Example 20

(Production of Releasing Agent Particle Water Dispersion W-1)

A 1 L-capacity beaker was charged with 120 g of deionized water, 86 g of the resin particle water dispersion A-1 and 40 g of a paraffin wax "HNP-9" (melting point: 75° C.) available from Nippon Seiro Co., Ltd., and the contents of the beaker were maintained at a temperature of 90 to 95° C. and melted, and then stirred, thereby obtaining a molten mixture. Then, while maintaining the resulting molten mixture at a temperature of 90 to 95° C., the mixture was subjected to dispersion treatment for 20 minutes using an ultrasonic homogenizer "US-600T" available from Nihon-seiki Kaisha Ltd., and then cooled to room temperature. Then, deionized water was added to the resulting dispersion so as to adjust a solid content of the dispersion to 20% by mass, thereby obtaining a releasing agent particle water dispersion W-1. The properties of the thus obtained releasing agent particle water dispersion W-1 are shown in Table 4.

Production Examples 21 to 24

(Production of Releasing Agent Particle Water Dispersions W-2 to W-5)

The same procedure as in Production Example 20 (the method for production of W-1) was repeated except that the kinds and amounts of releasing agents and resin particle water dispersions used were changed as shown in Table 4, thereby obtaining releasing agent particle water dispersions.

Production Example 25

(Production of Releasing Agent Particle Water Dispersion W-6)

The same procedure as in Production Example 20 (the method for production of W-1) was repeated except that 57 g of the resin particle water dispersion A-1 was replaced with 39 g of the resin particle water dispersion A-5, and the amount of the paraffin wax "HNP-9" (melting point: 75° C.) available from Nippon Seiro Co., Ltd., was changed from 40 g to 20 g to thereby attempt production of a releasing agent particle water dispersion. However, the attempt failed to produce the water dispersion as aimed.

TABLE 4

| Water dispersion of releasing agent particles | Production Example 20 W-1 | Production Example 21 W-2 | Production Example 22 W-3 | Production Example 23 W-4 | Production Example 24 W-5 | Production Example 25 W-6 |
|---|---|---|---|---|---|---|
| Components (g) | | | | | | |
| Releasing agent | | | | | | |
| Paraffin wax "HNP-9" | 40 | — | 40 | 40 | 40 | 20 |
| Ester wax "WEP-8" | — | 30 | | — | — | — |
| Water dispersion of resin particles | | | | | | |
| A-1 (solid content: 20% by mass) | 86 | 64 | | — | — | — |
| A-2 (solid content: 20% by mass) | — | — | 48 | — | — | — |
| A-3 (solid content: 20% by mass) | — | — | | 74 | — | — |
| A-4 (solid content: 20% by mass) | — | — | | — | 58 | — |
| A-5 (solid content: 20% by mass) | — | — | | — | — | 39 |
| Releasing agent/resin particles (mass ratio) | 100/43 | 100/43 | 100/24 | 100/37 | 100/29 | 100/39 |
| Volume median particle size ($D_{50}$) of releasing agent particles (μm) | 0.45 | 0.49 | 0.53 | 0.57 | 0.45 | Not dispersible |
| Solid content of releasing agent particle water dispersion (% by mass) | 20 | 20 | 20 | 20 | 20 | |

Note:

Paraffin wax "HNP-9"; melting point: 75° C.; available from Nippon Seiro Co., Ltd.

Ester wax "WEP-8"; melting point: 80° C.; available from NOF Corporation

[Production of Colorant Dispersion]

Production Example 26

(Production of Colorant Dispersion E-1)

A 1 L-capacity beaker was charged with 67.5 g of a copper phthalocyanine pigment "ECB-301" available from Dai-Nichi Seika Color & Chemicals Mfg. Co., Ltd., 90 g of an anionic surfactant "NEOPELEX (registered tradename) G-15" (a 15% by mass sodium dodecylbenzenesulfonate aqueous solution) available from Kao Corporation, and 149 g of deionized water. The contents of the beaker were mixed and dispersed using a homogenizer at room temperature for 3 hours, and then deionized water was added to the resulting dispersion such that the solid content of the dispersion was 25% by mass, thereby obtaining a colorant dispersion E-1. The colorant particles in the resulting colorant dispersion had a volume median particle size (DO of 0.125 μm.

Example 1

(Production of Toner 1)

A 2 L-capacity four-necked flask equipped with a dehydration tube, a stirrer and a thermocouple was charged with 200 g of the resin particle water dispersion B-1, 30 g of the releasing agent particle water dispersion W-1, 19 g of the colorant dispersion E-1 and 100 g of deionized water, and the contents of the flask were mixed with each other at 25° C. Then, while stirring the resulting mixture with a paddle-shaped stirrer, an aqueous solution prepared by dissolving 17 g of ammonium sulfate in 180 g of deionized water was added dropwise to the resulting mixture at 25° C. over 30 minutes. Next, the resulting mixed solution was heated to 58° C. and maintained at 58° C., thereby obtaining aggregated particles (1) having a volume median particle size ($D_{50}$) of 6.1 μm.

Subsequently, a mixed solution prepared by mixing 61 g of the resin particle water dispersion B-1 and 17 g of deionized water was added dropwise to the dispersion containing the thus obtained aggregated particles (1) over 90 minutes, thereby obtaining a water dispersion of aggregated particles (2) having a volume median particle size ($D_{50}$) of 6.8 μm.

An aqueous solution prepared by diluting 12 g of sodium polyoxyethylenelaurylethersulfate "EMAL E-27C" (anionic surfactant; solid content: 28% by mass) available from Kao Corporation with 1,241 g of deionized water was added to the thus obtained water dispersion of the aggregated particles (2). Then, the resulting dispersion was heated to 70° C. over 2 hours, and then maintained at 70° C. until the circularity of the respective aggregated particles reached 0.970, thereby obtaining coalesced particles having a volume median particle size ($D_{50}$) of 7.6 μm. Thereafter, the resulting dispersion was cooled to 25° C.

The water dispersion of the resulting coalesced particles were successively subjected to suction filtration to separate solids therefrom, and the thus separated solids were washed with deionized water and then dried at 33° C., thereby obtaining toner particles. The properties of the thus obtained toner particles are shown in Table 5. Next, 100 parts by mass of the toner particles, 2.5 parts by mass of a hydrophobic silica "11)(50" (number-average particle size: 0.04 μm) available from Nippon Aerosil Co., Ltd., and 1.0 part by mass of a hydrophobic silica "CAB-O-SIL (registered trademark) TS720" (number-average particle size: 0.012 m) available from Cabot Japan K.K. were charged into a Henschel mixer, stirred therein and then allowed to pass through a 150 mesh sieve, thereby obtaining a toner 1.

The kinds, properties, etc., of the releasing agent particle water dispersion and resin particle water dispersion used, as well as properties and evaluation results of the thus obtained toner are shown in Table 5.

Examples 2 to 5 and Comparative Examples 1 and 2

(Production of Toners 2 to 7)

The same procedure as in Example 1 was repeated except that the releasing agent particle water dispersion and resin particle water dispersion used were replaced with those shown in Table 5, thereby obtaining toners.

The kinds, properties, etc., of the releasing agent particle water dispersions and resin particle water dispersions used, as well as properties and evaluation results of the thus obtained toners are shown in Table 5.

TABLE 5

| Toner No. | Example 1<br>1 | Example 2<br>2 | Example 3<br>3 | Example 4<br>4 | Example 5<br>5 | Comparative Example 1<br>6 | Comparative Example 2<br>7 |
|---|---|---|---|---|---|---|---|
| Water Dispersion of releasing agent particles | | | | | | | |
| Releasing agent particle water dispersion No. | W-1 | W-1 | W-1 | W-2 | W-3 | W-4 | W-5 |
| Resin particle water dispersion No. | A-1 | A-1 | A-1 | A-1 | A-2 | A-3 | A-4 |
| Volume average particle size of resin particles (μm) | 0.07 | 0.07 | 0.07 | 0.07 | 0.04 | 0.06 | 0.05 |
| Volume median particle size of releasing agent particles (μm) | 0.45 | 0.45 | 0.45 | 0.49 | 0.53 | 0.57 | 0.45 |
| Water dispersion of resin particles (B1) | | | | | | | |
| Resin particle water dispersion No. | B-1 | B-2 | B-3 | B-3 | B-2 | B-2 | B-2 |
| Volume median particle size of resin particles (μm) | 0.22 | 0.09 | 0.13 | 0.13 | 0.09 | 0.09 | 0.09 |
| Water dispersion of resin | | | | | | | |

TABLE 5-continued

| Toner No. | Example 1 1 | Example 2 2 | Example 3 3 | Example 4 4 | Example 5 5 | Comparative Example 1 6 | Comparative Example 2 7 |
|---|---|---|---|---|---|---|---|
| particles (B2) | | | | | | | |
| Resin particle water dispersion No. | B-1 | B-4 | B-5 | B-5 | B-4 | B-4 | B-4 |
| Volume median particle size of resin particles (μm) | 0.22 | 0.24 | 0.21 | 0.21 | 0.24 | 0.24 | 0.24 |
| Properties of aggregated particles (1) | | | | | | | |
| Volume median particle size (μm) | 6.1 | 5.3 | 4.2 | 4.7 | 4.7 | 3.7 | 3.7 |
| Properties of aggregated particles (2) | | | | | | | |
| Volume median particle size (μm) | 6.8 | 5.6 | 4.8 | 5.7 | 6.2 | 5.0 | 5.1 |
| Amount of fine powder (m1) (% by mass) | 3.9 | 3.4 | 2.2 | 3.1 | 4.2 | 5.0 | 5.4 |
| Properties of coalesced particles | | | | | | | |
| Circularity | 0.974 | 0.973 | 0.974 | 0.977 | 0.973 | 0.970 | 0.972 |
| Properties of toner | | | | | | | |
| Volume median particle size (μm) | 7.6 | 6.0 | 5.0 | 5.8 | 6.5 | 6.1 | 5.4 |
| Amount of fine powder (m2) (% by mass) | 3.9 | 4.5 | 2.6 | 3.3 | 6.6 | 16.1 | 16.7 |
| Evaluation of toner | | | | | | | |
| Amount of change in amount of fine powder (m2 − m1) (% by mass) | 0.0 | 1.1 | 0.4 | 0.2 | 2.4 | 11.1 | 11.3 |
| Solid-image followup ability (%) | 4 | 9 | 6 | 5 | 14 | 53 | 62 |

From Table 5, it was confirmed that the toners obtained in Examples 1 to 5 all exhibited a very small amount of change in amount of the fine powder indicating an amount of the releasing agent desorbed therefrom, and were prevented from suffering from exposure of the releasing agent onto the surface of the toner particles and therefore were also excellent in solid-image followup ability as compared to the toners obtained in Comparative Examples 1 and 2.

INDUSTRIAL APPLICABILITY

In the process for producing a toner for development of electrostatic images and the process for producing a water dispersion of releasing agent particles according to the present invention, it is possible to produce a toner for development of electrostatic images which is capable of providing a toner that can be prevented from suffering from desorption and exposure of the releasing agent and is excellent in solid-image followup ability upon printing.

The invention claimed is:

1. A process for producing a toner for development of electrostatic images, the process comprising:

mixing a releasing agent and a water dispersion comprising resin particles (A) to obtain a water dispersion comprising releasing agent particles containing the resin particles (A), wherein said mixing is performed by a dispersion treatment at a temperature not lower than a melting point of the releasing agent using a disperser;

mixing the water dispersion comprising the releasing agent particles containing the resin particles (A) with a water dispersion comprising resin particles (B) to aggregate the releasing agent particles and the resin particles (B), thereby obtaining aggregated particles; and coalescing the aggregated particles to obtain coalesced particles, wherein the resin particles (A) comprise a composite resin comprising a segment (a1) comprising a polyester resin, and a vinyl-based resin segment (a2) comprising a constitutional unit derived from a styrene-based compound;

wherein a resin constituting the resin particles (B) comprises a segment (b1) comprising a polyester resin in an amount of not less than 50% by mass; and wherein a mass ratio of the releasing agent to the resin particles (A) [releasing agent/resin particles (A)] is from 100/1 to 100/100.

2. The process for producing a toner for development of electrostatic images according to claim 1, wherein the resin particles (A) comprise the composite resin in an amount of not less than 90% by mass.

3. The process for producing a toner for development of electrostatic images according to claim 1, wherein a content of a surfactant if present in the water dispersion comprising the releasing agent particles is not more than 1 part by mass on the basis of 100 parts by mass of the releasing agent.

4. The process for producing a toner for development of electrostatic images according to claim 1, wherein the releasing agent comprises a paraffin wax in an amount of not less than 95% by mass.

5. The process for producing a toner for development of electrostatic images according to claim 1, wherein the vinyl-based resin segment (a2) further comprises a constitutional unit derived from a bireactive monomer.

6. The process for producing a toner for development of electrostatic images according to claim 1, wherein a volume average particle size ($D_v$) of the resin particles (A) is not less than 0.02 μm and not more than 1.00 μm.

7. The process for producing a toner for development of electrostatic images according to claim 1, wherein a volume average particle size ($D_v$) of the resin particles (A) is not less than 0.02 μm and not more than 0.50 μm.

8. The process for producing a toner for development of electrostatic images according to claim 1, wherein the water dispersion comprising the resin particles (A) further comprises water in an amount of not less than 90% by mass on the basis of a dispersing medium in the water dispersion comprising the resin particles (A).

9. The process for producing a toner for development of electrostatic images according to claim 1, wherein the water dispersion comprising the resin particles (B) further comprises water in an amount of not less than 90% by mass on the basis of a dispersing medium in the water dispersion comprising the resin particles (B).

10. The process for producing a toner for development of electrostatic images according to claim 1, wherein a volume median particle size ($D_{50}$) of the releasing agent particles is not less than 0.05 μm and not more than 1.00 μm.

11. The process for producing a toner for development of electrostatic images according to claim 1, wherein a content of the vinyl-based resin segment (a2) in the composite resin is not less than 5% by mass and not more than 60% by mass.

12. The process for producing a toner for development of electrostatic images according to claim 1, wherein a ratio of a volume median particle size ($D_{50}$) of the releasing agent particles to a volume average particle size ($D_v$) of the resin particles (A) (volume median particle size ($D_{50}$) of releasing agent particles/volume average particle size ($D_v$) of resin particles (A)) is not less than 1.0 and not more than 50.

13. The process for producing a toner for development of electrostatic images according to claim 1, wherein the mixing of the water dispersion comprising the releasing agent particles and the water dispersion comprising the resin particles (B) comprises:

mixing the water dispersion comprising the releasing agent particles, the water dispersion comprising the resin particles (B), and an aggregating agent with each other in an aqueous medium to obtain aggregated particles (1); and then adding the resin particles (B) to the aggregated particles (1) at one time or a plurality of times in a split addition manner to obtain aggregated particles (2) formed by adhering the resin particles (B) to the aggregated particles (1) (resin particle (B)-adhered aggregated particles).

14. The process for producing a toner for development of electrostatic images according to claim 1, wherein a content of a fine powder if present in the toner particles or toner is not more than 10% by mass.

15. A process for producing a water dispersion comprising releasing agent particles containing resin particles (A), the process comprising:

mixing a releasing agent and a water dispersion comprising resin particles (A) to obtain the water dispersion comprising the releasing agent particles containing the resin particles (A), wherein said mixing is performed by a dispersion treatment at a temperature not lower than a melting point of the releasing agent using a disperser, wherein the resin particles (A) comprise a composite resin comprising:

a segment (a1) comprising a polyester resin, and a vinyl-based resin segment (a2) comprising a constitutional unit derived from a styrene-based compound in an amount of not less than 90% by mass, and wherein a mass ratio of the releasing agent to the resin particles (A) [releasing agent/resin particles (A)] is from 100/1 to 100/100.

16. The process for producing a water dispersion comprising releasing agent particles according to claim 15, wherein a content of a surfactant if present in the water dispersion comprising the releasing agent particles is not more than 1 part by mass on the basis of 100 parts by mass of the releasing agent present in the releasing agent particles.

17. The process for producing a water dispersion comprising releasing agent particles according to claim 15, wherein a ratio of a volume median particle size ($D_{50}$) of the releasing agent particles to a volume average particle size ($D_v$) of the resin particles (A) (volume median particle size ($D_{50}$) of releasing agent particles/volume average particle size ($D_v$) of resin particles (A)) is not less than 1.0 and not more than 50.

18. The process for producing a water dispersion comprising releasing agent particles according to claim 15, wherein the water dispersion comprising the releasing agent particles is obtained by dispersing the releasing agent and the resin particles (A), if required together with an aqueous medium, at a temperature not lower than a melting point of the releasing agent.

* * * * *